US009583285B1

(12) United States Patent
Andre et al.

(10) Patent No.: US 9,583,285 B1
(45) Date of Patent: Feb. 28, 2017

(54) DEVICE HOUSING HAVING IMPROVED TOLERANCES

(71) Applicant: Apple Inc., Cupertino, CA (US)

(72) Inventors: Bartley K. Andre, Cupertino, CA (US); Mikael Silvanto, Cupertino, CA (US); Houtan Farahani, Cupertino, CA (US); Gavin J. Reid, Cupertino, CA (US); Jason Keats, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/550,250

(22) Filed: Nov. 21, 2014

Related U.S. Application Data

(60) Provisional application No. 61/908,078, filed on Nov. 23, 2013.

(51) Int. Cl.
*H01H 1/64* (2006.01)
*H01H 9/02* (2006.01)

(52) U.S. Cl.
CPC ..... *H01H 9/02* (2013.01); *H01H 2223/036* (2013.01)

(58) Field of Classification Search
CPC ..... H01H 2223/012; H01H 2223/00; H04M 1/0249; H04M 1/0252; G06F 3/03543
USPC ..... 361/679.01, 679.02; 200/293, 345; 455/347
See application file for complete search history.

(56) References Cited

U.S. PATENT DOCUMENTS 5,026,101 A * 6/1991 Dotterweich ..... E05C 1/14 292/166
8,101,859 B2 * 1/2012 Zadesky ..... G06F 1/1626 174/17 R
8,787,029 B2 * 7/2014 Yang ..... H01H 9/16 200/341
2010/0206601 A1 * 8/2010 Choraku ..... H05K 5/061 174/50.5

* cited by examiner

*Primary Examiner* — Vanessa Girardi
(74) *Attorney, Agent, or Firm* — Brownstein Hyatt Farber Schreck, LLP

(57) ABSTRACT

Input elements, handles, enclosures and alignment of such elements and handles within an electronic device. The elements, such as buttons or input devices, and handles discussed herein may be configured, assembled and/or installed within and/or on an electronic device to ensure proper alignment and positioning within the housing of the electronic device. By properly aligning and positioning the elements and handles within or on the housing of the electronic device, the elements and handles may provide accurate input to the electronic device and may be visually appealing to a user. Additionally, a two-piece enclosure including a hook and cutout portion may secure and/or protect the internal components of the electronic device, while also providing a visually "seamless" connection between the two-pieces for forming the enclosure of the electronic device.

31 Claims, 21 Drawing Sheets

DEVICE HOUSING HAVING IMPROVED TOLERANCES

CROSS-REFERENCE TO RELATED APPLICATION

This application is a nonprovisional patent application of and claims the benefit to U.S. Provisional Patent Application No. 61/908,078, filed Nov. 23, 2013 and titled "Device Housing Having Improved Tolerances," the disclosure of which is hereby incorporated herein by reference in its entirety.

TECHNICAL FIELD

Embodiments described herein relate generally to housings for electronic devices, and more particularly to input elements, handles, enclosures and alignment of such elements handles, and enclosures within the electronic device.

BACKGROUND

Electronic devices including conventional button assemblies often require the internal components to be coupled to a housing of the device, prior to the positioning of the external button within an opening of the housing. As a result of the internal components being fixed prior to the installation of the external button, the alignment of the button within the opening of the housing may be off-center.

In some embodiments, the external button may be positioned within the opening of the housing and may be subsequently coupled to the fixed internal components of the button assembly. Unless the internal component of the button assembly is perfectly centered on the opening of the housing, the external button will be off-center (e.g., non-concentric) with the opening. The non-concentric positioning of the external button within the housing may affect functionality of the button if the button contacts and/or catches the edge of the opening during actuation of the button. Additionally, where the button is not concentric with the opening of the housing, the aesthetic or cosmetic appearance of the electronic device may be negatively affected.

Electronic devices also typically include two-piece casing systems for securing internal components. It is desired for these cases to maintain a strong connection to prevent undesirable exposure of the internal components of the electronic device. That is, where casing system includes a top case and a bottom case, it is desired that neither case comes unintentionally loose or becomes disconnected from one another. Conventionally, this may be achieved by including external fasteners (e.g., screws, snap-fits, etc.) that couple the two distinct cases. However, because these fasteners are exposed, they become vulnerable to failing due to normal wear-and-tear or usage of the electronic device. Additionally, because the fasteners are typically exposed or provided on the outside of the electronic device, the top case (e.g., exposed case) usually includes multiple holes, hinges and/or connection points for receiving the fasteners to couple the two cases. These features can be aesthetically, or cosmetically unappealing to a user of the electronic device.

SUMMARY

Generally, embodiments discussed herein are related to input elements, handles, enclosures and alignment of such elements and handles within an electronic device. The elements, such as buttons or input devices, and handles discussed herein may be configured, assembled and/or installed within and/or on an electronic device to ensure proper alignment and positioning within the housing of the electronic device. By properly aligning and positioning the elements and handles within or on the housing of the electronic device, the elements and handles may provide accurate input to the electronic device and may be visually appealing to a user. Additionally, a two-piece enclosure including a hook and cutout portion may secure and/or protect the internal components of the electronic device, while also providing a visually "seamless" connection between the two-pieces for forming the enclosure of the electronic device.

One embodiment may include a button assembly. The button assembly may include a body portion, a contact portion coupled to the body portion, and a sacrificial material coupled to and surrounding at least a portion of the body portion. The sacrificial material may contact and couple the body portion to an aperture formed through a housing of an electronic device. The button assembly may also include an internal component coupled to the contact portion, opposite the body portion. The internal component may be coupled to the housing of the electronic device subsequent to the coupling of the body portion to the aperture via the sacrificial material.

Another embodiment may include a method of installing a button assembly within a housing of an electronic device. The method may include determining an inner diameter of an aperture formed in the housing of the electronic device, removing at least a portion of a sacrificial material coupled to and surrounding at least a portion of a body portion of the button assembly, positioning the body portion of the button assembly within the aperture of the housing, and affixing the button assembly to the housing of the electronic device.

a further embodiment may include a casing assembly. The casing assembly may comprise a bottom case having a cavity, a hook extending into the cavity, and an angled reveal surface surrounding the cavity. The casing assembly may also comprise a top case at least partially positioned within the cavity of the bottom case. The top case may include a cutout for receiving a hook to couple the top case to the bottom case, and a straight underside positioned adjacent to and partially abutting the angled reveal surface of the bottom case.

An additional embodiment may include a method of assembling a casing assembly for an electronic device. The method may include inserting a top case into a bottom case, abutting at least a portion of a straight underside of the top case with an angled reveal surface of the bottom case. The abutment between the portion of the straight underside of the top case and the angled reveal surface of the bottom case may be concealed from visibility. The method may also include rotating at least one of the top case and the bottom case, and engaging a hook of the bottom case with an angled contact surface of a cutout formed in the top case.

More embodiments may include a handle assembly. The handle assembly may comprise a housing portion comprising a blind hole, and a handle portion coupled to the housing portion. The handle portion may include a through hole in substantial alignment with and angularly offset from the blind hole of the housing portion. The handle assembly may also comprise a coupling mechanism positioned within the blind hole of the housing portion and the through hole of the handle portion for coupling the handle portion to the housing portion. Additionally within the handle assembly, the handle portion may automatically move from a first position to a second position relative to the housing portion subsequent to moving the handle portion past an angular threshold.

Further embodiments may include a gap control button assembly. The gap control button assembly may comprise a body portion, an internal component positioned opposite the body portion, and a pin portion coupled to and positioned between the body portion and the internal component. The pin portion may be positioned is coupled to the body portion out of alignment with a center of the body portion.

Another embodiment may include a method of centering a gap control button assembly within an opening of a housing. The method may comprise determining a desired distance between the opening of the housing and a body portion of the gap control button assembly, determining an actual distance between the body portion of the gap control button assembly and the opening of the housing, and rotating the body portion about an off-center pin portion of the gap control button assembly coupled to the body portion.

BRIEF DESCRIPTION OF THE DRAWINGS

The disclosure will be readily understood by the following detailed description in conjunction with the accompanying drawings, wherein like reference numerals designate like structural elements, and in which.

Figure 1:
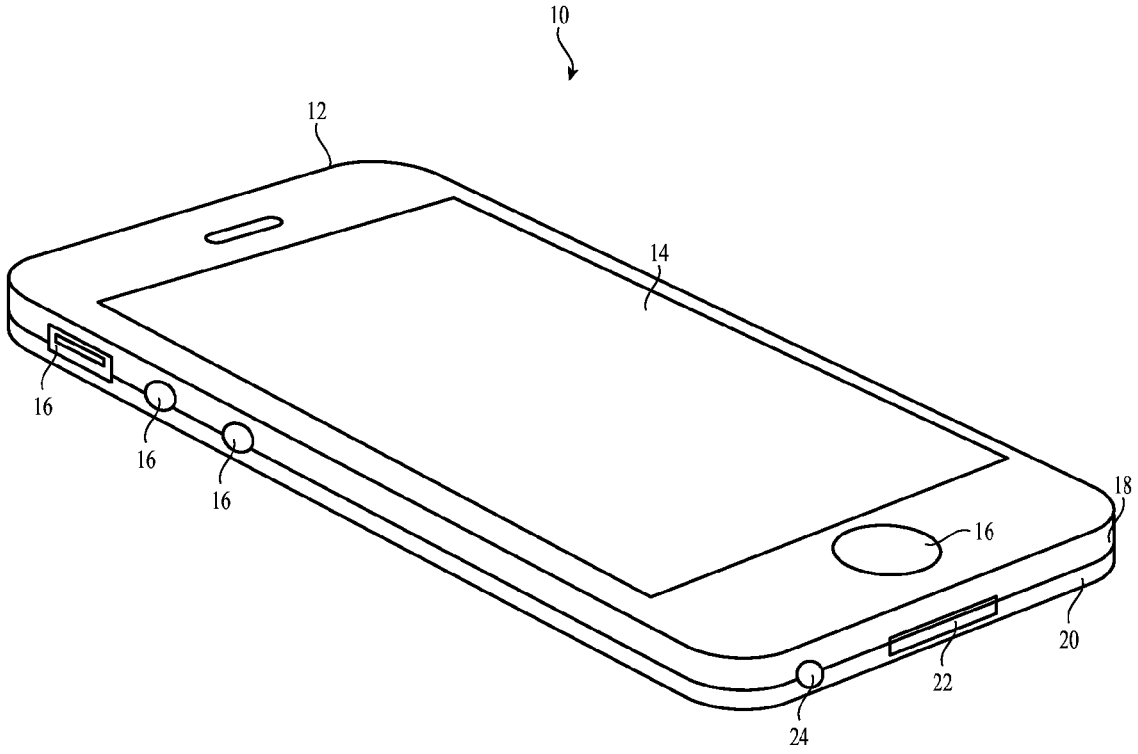
FIG. 1 shows an illustrative perspective view of an electronic device, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to housings for electronic devices, and more particularly to input elements, handles, enclosures, and alignment of such elements and handles within the electronic device.

The embodiments discussed herein are related to input elements, handles, enclosures and alignment of such elements and handles within an electronic device. The elements, such as buttons or input devices, and handles discussed herein may be configured, assembled and/or installed within and/or on an electronic device to ensure proper alignment and positioning within the housing of the electronic device. By properly aligning and positioning the elements and handles within or on the housing of the electronic device, the elements and handles may provide accurate input to the electronic device and may be visually appealing to a user. Additionally, a two-piece enclosure including a hook and cutout portion may secure and/or protect the internal components of the electronic device, while also providing a visually "seamless" connection between the two-pieces for forming the enclosure of the electronic device.

These and other embodiments are discussed below with reference to FIGS. 1-19C. However, those skilled in the art will readily appreciate that the detailed description given herein with respect to these Figures is for explanatory purposes only and should not be construed as limiting.

FIG. 1 depicts a perspective view of one example of an electronic device 10. In the illustrated embodiment, electronic device 10 is implemented as a smart telephone. Other embodiments can implement electronic device 10 differently, such as, for example, as a laptop or desktop computer, a tablet computing device, a gaming device, a display, a digital music player, a wearable computing device or display, a health monitoring device, and so on.

Electronic device 10 includes an enclosure 12 at least partially surrounding a display 14 and one or more buttons 16 or input devices. Enclosure 12 can form an outer surface or partial outer surface and protective case for the internal components of the electronic device 10, and may at least partially surround display 14. Enclosure 12 can be formed of one or more components operably connected together, such as a top case 18 and a bottom case 20, as shown in FIG. 1. Alternatively, enclosure 12 can be formed of a single piece operably connected to display 14. Additionally, enclosure 12 may be formed from a variety of material including, but not limited to: reinforced glass, plastic, artificially grown corundum, and any combination of material.

Display 14 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. Button 16 can take the form of a home button, which may be a mechanical button, a soft button (e.g., a button that does not physically move but still accepts inputs), an icon or image on a display, and so on. Further, in some embodiments, button 16 can be integrated as part of a cover glass of the electronic device.

Electronic device 10 may also include a plurality of openings throughout enclosure 12. The openings in enclosure 12 of electronic device 10 may provide access from external comments of electronic device 10 to internal components. In a non-limiting example, electronic device 10 may include a battery charging port 22 formed through enclosure 12. Battery charging port 22 may be in electronic communication with a battery (not shown) of electronic device 10.

Additionally as shown in FIG. 1 electronic device 10 may include headphone port 24. In the non-limiting example, an opening may be formed enclosure 12 to form headphone port 24 within electronic device 10. Headphone port 24 may be in electrical communication with to an audio or headphone system (not shown) positioned within enclosure 12, and may be configured receive a headphone jack (not shown) for allowing a user to listen to audio produced by electronic device 10 using personal headphone.

Figure 2:
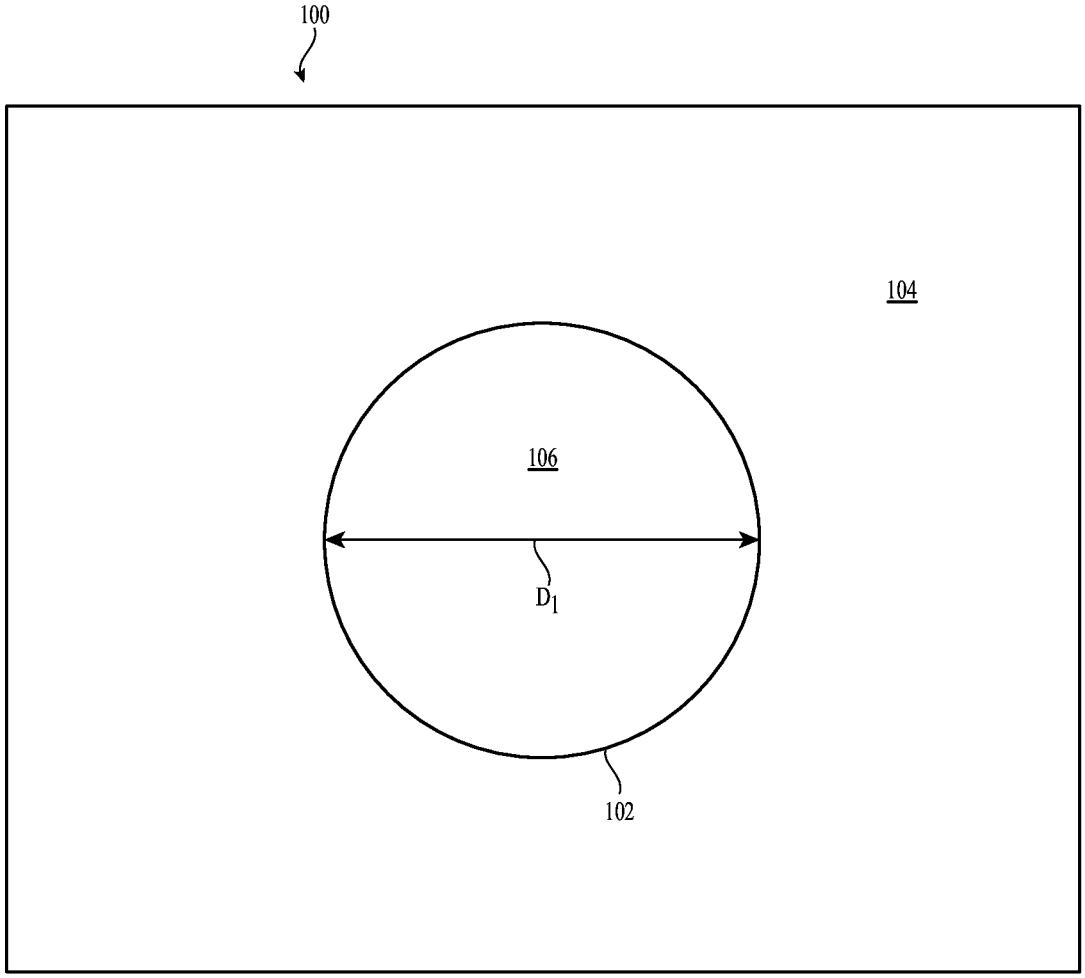
FIG. 2 shows a top perspective view of a portion of a housing including an aperture, according to embodiments.
Figure 3:
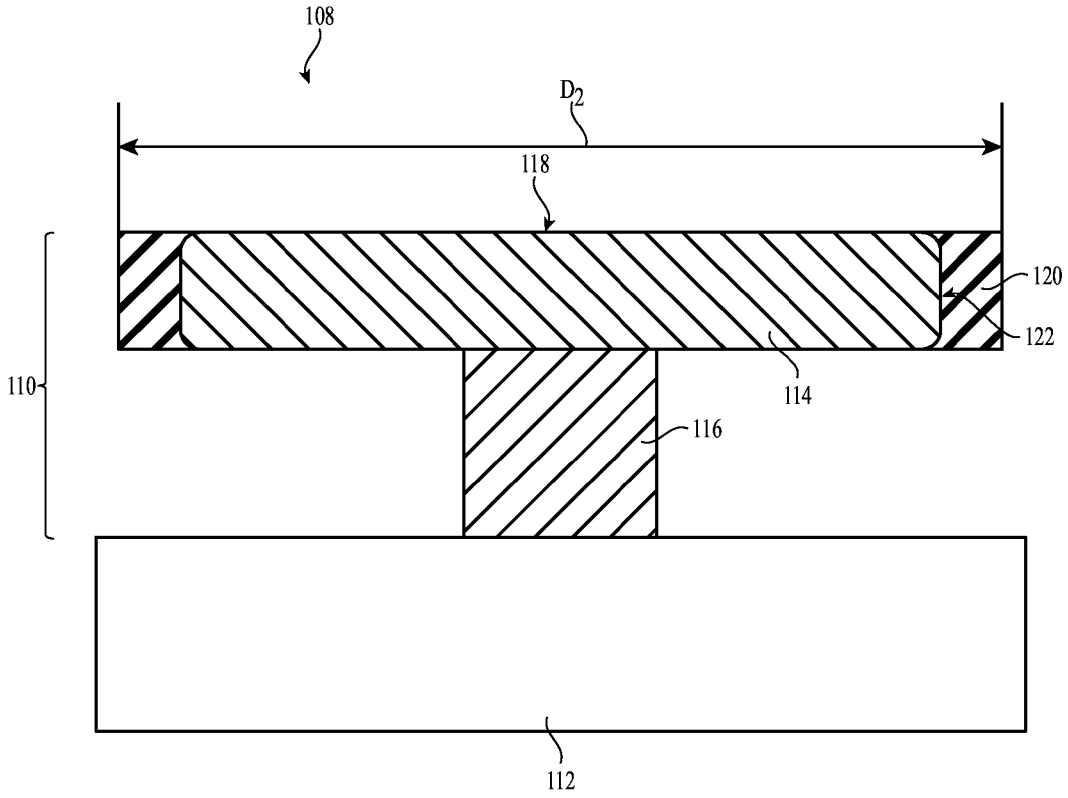
FIG. 3 shows a side cross-section view of a button assembly according to embodiments.
Figure 4:
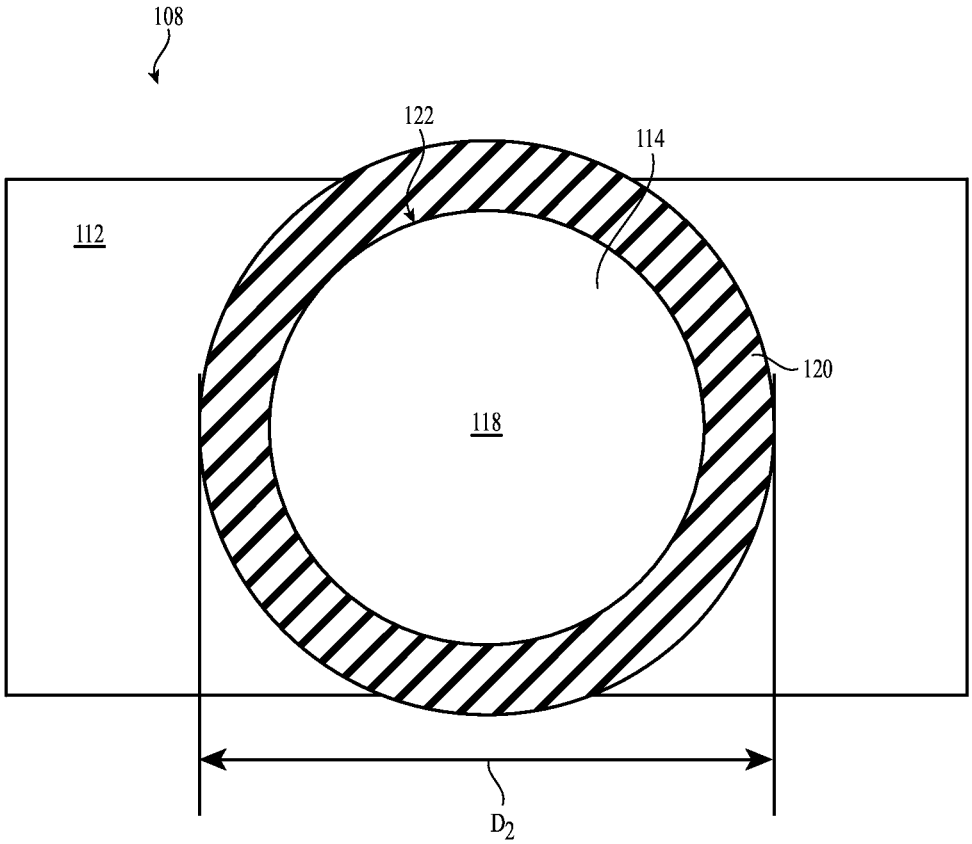
FIG. 4 shows a top view of the button assembly shown in FIG. 3, according to embodiments.

FIG. 2 shows a top perspective view of a portion of a housing 100 including an aperture 102, according to certain embodiments. Housing 100, as shown in FIG. 2, may be any external enclosure or casing for an electronic device (see, FIG. 1; enclosure 12), including, but not limited to: a computer, a tablet, a cellular phone, a personal music device, a wearable device, and so on. Aperture 102 may extend through at least a top surface 104 of housing 100 to internal cavity 106 of housing 100. As discussed herein, aperture 102 and/or cavity 106 may be configured to receive a button assembly 108 (see. FIG. 3) utilized by the electronic device and extending through the aperture.

Aperture 102 of housing 100 may include a first diameter ($D_1$). The first diameter ($D_1$) of aperture 102 may be determined during the manufacturing processes of forming housing 100, and may be based on, at least in part, the dimensions of button assembly 108 and/or various components of button assembly 108.

Turning to FIG. 3, a side cross-sectional view of a button assembly 108 is shown. Button assembly 108, as shown in FIG. 3, may be any suitable button or input device of an electronic device (see, FIG. 1; buttons 16). Button assembly 108 may include a button 110 and an internal component 112 operatively and/or mechanically connected to button 110. Button 110 of button assembly 108 may include a body portion 114 positioned above internal component 112 and a contact portion 116 positioned between body portion 114 and internal component 112. As discussed herein, a top surface 118 of body portion 114 may be exposed when button assembly 108 is positioned within housing 100.

During the actuation of button 110, contact portion 116 may substantially contact internal component 112, to initiate a function of button assembly 108. In a non-limiting example, where button assembly 108 may turn on a light of the electronic device (see, FIG. 1), actuation of button 110 may complete an electrical connection to provide a signal or power to the light of electronic device, and the light may ultimately illuminate. In a non-limiting example shown in FIG. 3, contact portion 116 may be formed from a distinct component and may be coupled to body portion 114 and internal component, respectively. Alternatively, contact portion 116 may be formed integral with body portion 114 to form button 110 of button assembly 108.

Button assembly 108 may also include a sacrificial material 120. In the non-limiting example shown in FIGS. 3 and 4, sacrificial material 120 may be concentrically coupled to body portion 114 of button 110. In the non-limiting example, sacrificial material 120 of button assembly 108 may be configured as an O-ring positioned around a perimeter or an outer surface 122 of body portion 114, and may be made of any suitable low-friction material, one example of which is TEFLON. As shown in FIG. 3, sacrificial material 120 may include a height less than or equal to the height of body portion 114 of button assembly 108. Body portion 114 of button 110, including sacrificial material 120, may include a second diameter (D2), substantially greater than the first diameter (D1) of aperture 102 of housing 100 (see, FIG. 2). Although the O-ring is shown as encompassing an entirety of the body portion 114 of the button 110, the O-ring (including the sacrificial material 120) may be at least partially received within a groove defined along the circumference of the body portion in other embodiments, and/or may not extend along an entirety of the sidewall of the body portion 114.

As discussed herein, a portion of sacrificial material 120 may be removed from body portion 114 of button 110 prior to positioning and coupling button assembly 108 within housing 100. Additionally, as discussed herein, sacrificial material 120 of button assembly 108 may aid in substantially centering body portion 114 of button 110 within aperture 102 when button assembly 108 is positioned within and coupled to housing 100.

Figure 5:
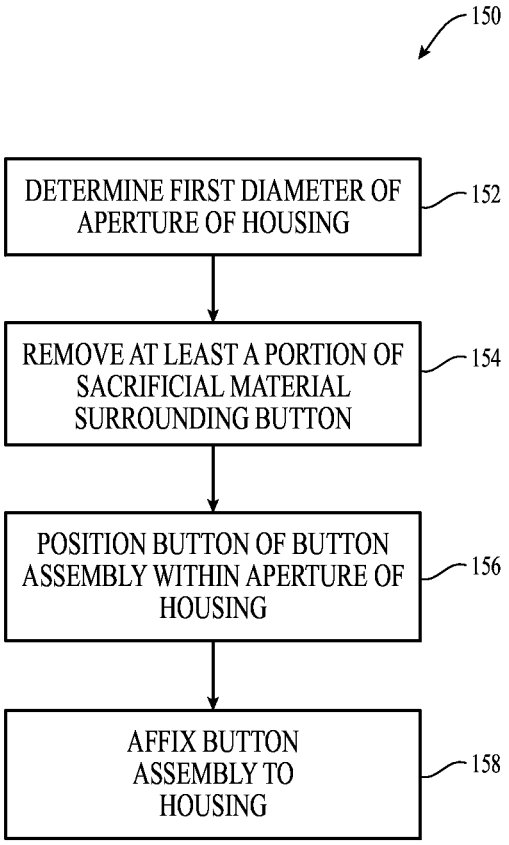
FIG. 5 is a flow chart illustrating a method for installing a button assembly within a housing. This method may be performed using the housing and button assembly as shown in FIGS. 2-4.

Turning to FIG. 5, a process of installing button assembly within housing may now be discussed. Specifically, FIG. 5 is a flowchart depicting one sample method 150 for installing or positioning button assembly within housing.

In operation 152, a first diameter of an aperture of a housing may be determined. In operation 154, at least a portion of a sacrificial material surrounding a button may be removed from a button assembly. The removal of the sacrificial material may reduce a second diameter of the button to be substantially equal to the first diameter of the aperture formed through the housing. In operation 156, the button assembly may be positioned within the aperture and/or the housing. In operation 158, the button assembly may be affixed to the housing.

Figure 6A:
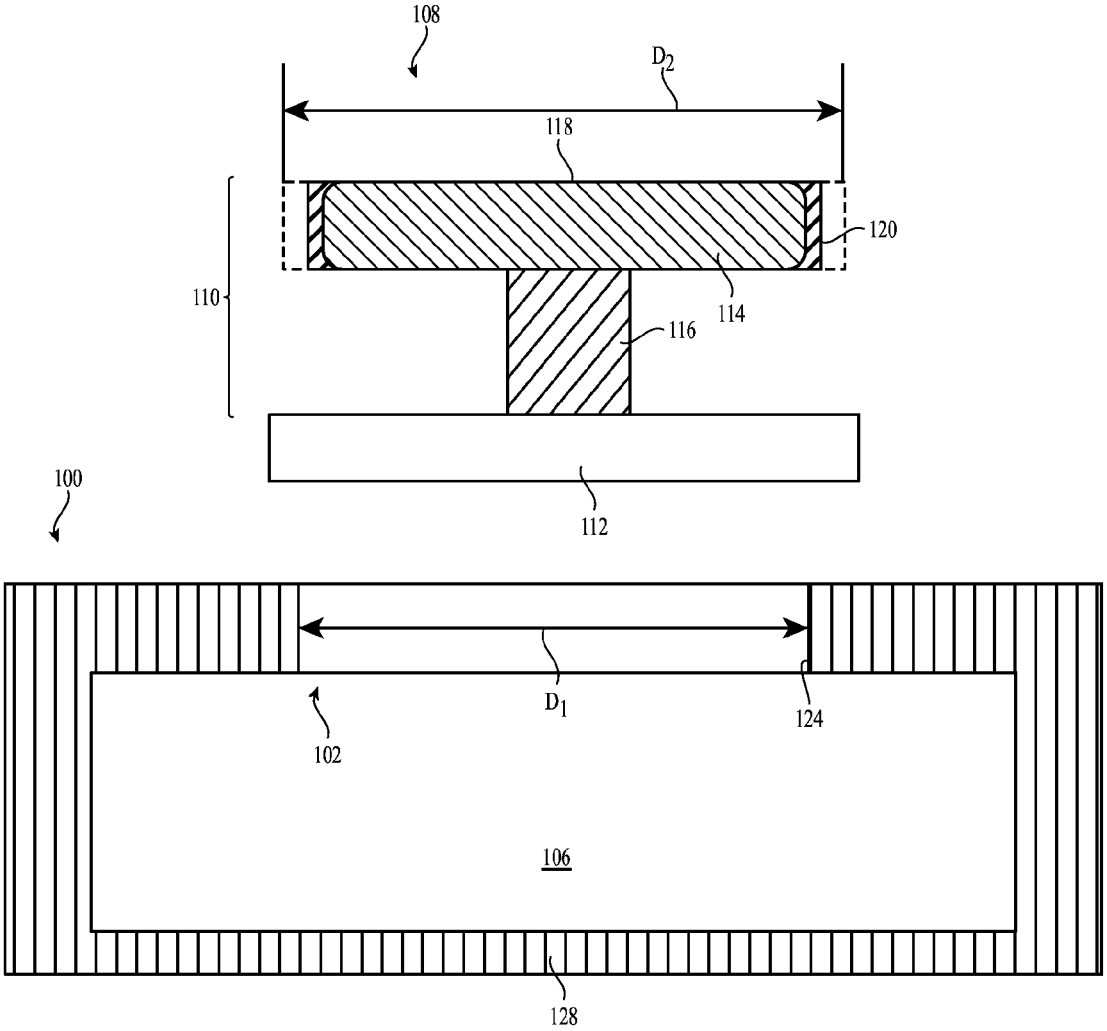
FIGS. 6A-6C shows illustrative views of a button assembly and housing undergoing processes of installation as depicted in FIG. 3, according to embodiments.
Figure 6B:
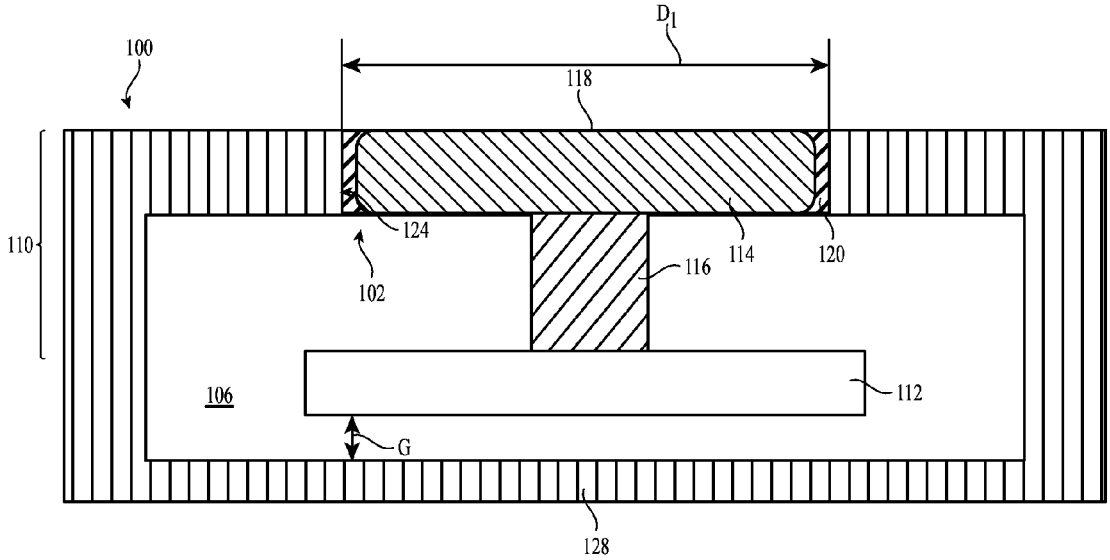
Figure 6C:
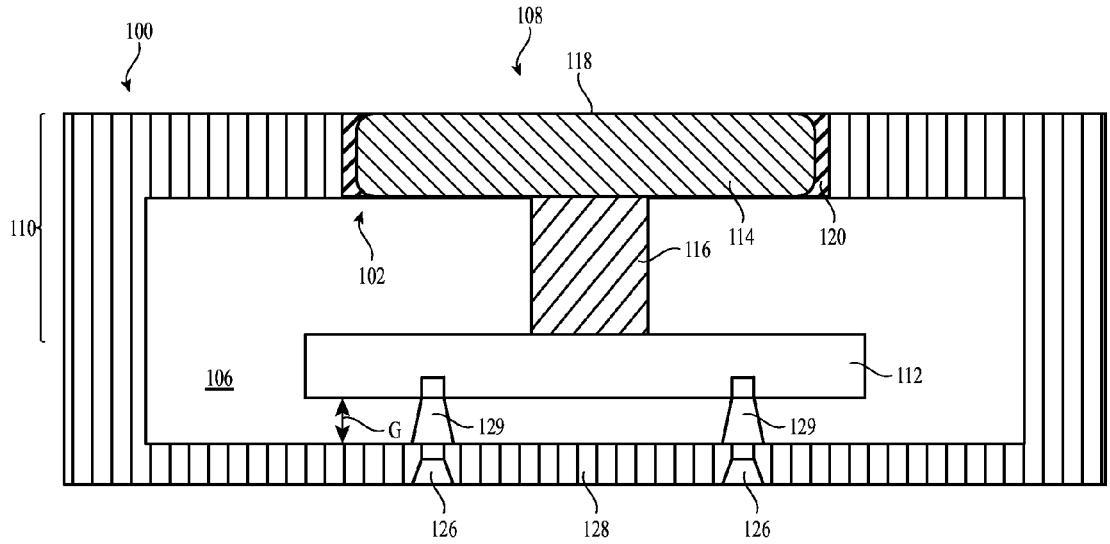

Turning to FIGS. 6A-6C, a sample button assembly 108 and housing 100 undergoing various operations of method 150 of FIG. 5 may be depicted. It is understood that similarly numbered components may function in a substantially similar fashion. Redundant explanation of these components has been omitted for clarity.

As shown in FIG. 6A, a first operation of installing button assembly 108 includes determining the first diameter ($D_1$) of aperture 102 of housing 100. The first operation of determining, as shown in FIG. 6A, may correspond to operation 152. As discussed herein, first diameter ($D_1$) of aperture 102 may be predetermined during the manufacturing of housing 100. Alternatively, first diameter ($D_1$) of aperture 102 may be determined after housing 100 is manufactured, and prior to button assembly 108 being installed within housing 100. First diameter ($D_1$) of aperture 102 may be determined using various techniques and/or measuring tools including, but not limited to: optical scans, micrometers, pressure sensitive impressions, and so on.

FIG. 6A shows button assembly 108, including the O-ring of sacrificial material 120, prior to seating the button assembly 108 within the aperture 102. As part of or prior to seating the button assembly 108, a portion of the sacrificial material 120 forming O-ring may be removed (as shown in phantom) from button assembly 108. In a non-limiting example of FIG. 6A, a portion of sacrificial material 120 (shown in phantom) may be removed from body portion 114 of button 110, such that the second diameter ($D_2$) is reduced to be substantially equal to the first diameter ($D_1$) of aperture 102 of housing 100. As a result button 110, and specifically body portion 114, may fit within aperture 102 of housing 100. The portion of sacrificial material 120 of button 110 may be removed using any suitable material removal technique including, but not limited to: turning, milling, grinding, drilling, and so on. The removal of at least a portion of the sacrificial material 120, shown in FIG. 6A, may correspond to operation 154.

Additionally, it is understood that sacrificial material 120 may be pre-cut before being concentrically coupled to body portion 114 of button 110. That is, subsequent to being concentrically coupled to body portion 114, sacrificial material 120 may be machined to a determined thickness based on first diameter (D1). The machined thickness of sacrificial material 120 may provide body portion 114 with an additional diameter/thickness, such that body portion 114 of button 110, including the machined sacrificial material 120, includes a second diameter (D2) substantially equal to the first diameter (D1) of aperture 102 of housing 100.

Turning to FIG. 6B, the button assembly 108 is shown positioned within the housing 100. In a non-limiting example, button assembly 108 may be positioned within housing 100 by inserting internal component 112 within housing 100 via aperture 102. Once internal component 112 of button assembly 108 is inserted to housing 100, body portion 114 of button 110 may be substantially fixed within aperture 102 of housing 100. In the non-limiting example shown in FIG. 6B, sacrificial material 120 concentrically positioned around body portion 114 of button 110 may be coupled to, and/or positioned adjacent an inner surface 124 of aperture 102 to hold button assembly 108 in place. The positioning of button assembly 108 within housing 100, shown in FIG. 6B, may correspond to operation 156.

Because the first diameter ($D_1$) of aperture 102 and second diameter ($D_2$) of body portion 114 are made equal or near-equal (for example, through removal of sacrificial material 120), body portion 114 may be coupled to, or substantially fixed within, aperture 102 via a friction or compression fit between inner surface 124 of aperture 102 and the sacrificial material 120 of button 110. As shown in FIG. 6B, top surface 118 of button 110 may be exposed from housing 100. Due to the substantially circular shape of aperture 102 and body portion 114, and the uniform thickness of sacrificial material 120, and the additional processing to ensure the first diameter ($D_1$) is equal to the second diameter ($D_2$), body portion 114 of button 110 may be substantially concentric with aperture 102 of housing 100.

Additionally, as shown in FIG. 6B, internal component 112 may be free-floating within housing 100. That is, internal component 112 of button assembly 108 may be suspended within housing 100, and there may be a gap (G) between housing 100 and internal component 112. Internal component 112 may be supported by button 110 and the fit of body portion 114 within aperture 102 of housing 100.

FIG. 6C depicts the button assembly 108 positioned within housing 100, with internal component 112 of button assembly 108 affixed to housing 100. As shown in FIG. 6C, and with comparison to FIG. 6B, internal component 112 of button assembly 108 may be coupled to housing 100 while still being suspended above housing 100 (e.g., gap (G)). Internal component 112 may be coupled to housing 100 by any suitable mechanical coupling technique now known, or later developed. In a non-limiting example shown in FIG. 6C, a screw-cushion component 126 may be positioned through a base 128 of housing 100, and may extend at least partial through internal component 112. The cushions 129 of screw-cushion component 126 may be positioned between internal component 112 and base 128 of housing 100 to provide additional support to button assembly 108 within housing 100. The affixing of button assembly 108 to housing 100, shown in FIG. 6C, may correspond to operation 158.

It should be appreciated that the internal component 112 may be affixed to the housing 100 after the sacrificial material is removed and the button 108 is positioned within, and centered in, the aperture 102 of housing 100. In this manner, the centering of the button 108 may be decoupled from the exact position of the internal component 112 and the internal component 112 may not dictate a particular location of the button 108 within the aperture 102.

By including sacrificial material 120 in button assembly 108, body portion 114 of button 110 may be concentrically positioned within aperture 102 of housing 100 without the risk of being off-center. Additionally, by including sacrificial material 120 around body portion 114 of button 110 to form a compression fit within aperture 102 of housing 100, internal component 112 may be attached to housing 100 after button 110 is positioned concentrically within aperture 102. As a result, internal component 112 may no longer negatively affect the positioning of button 110 (e.g., off-center), as the position of internal component 112 within housing 100 is determined by the positioning of button 110.

Figure 7:
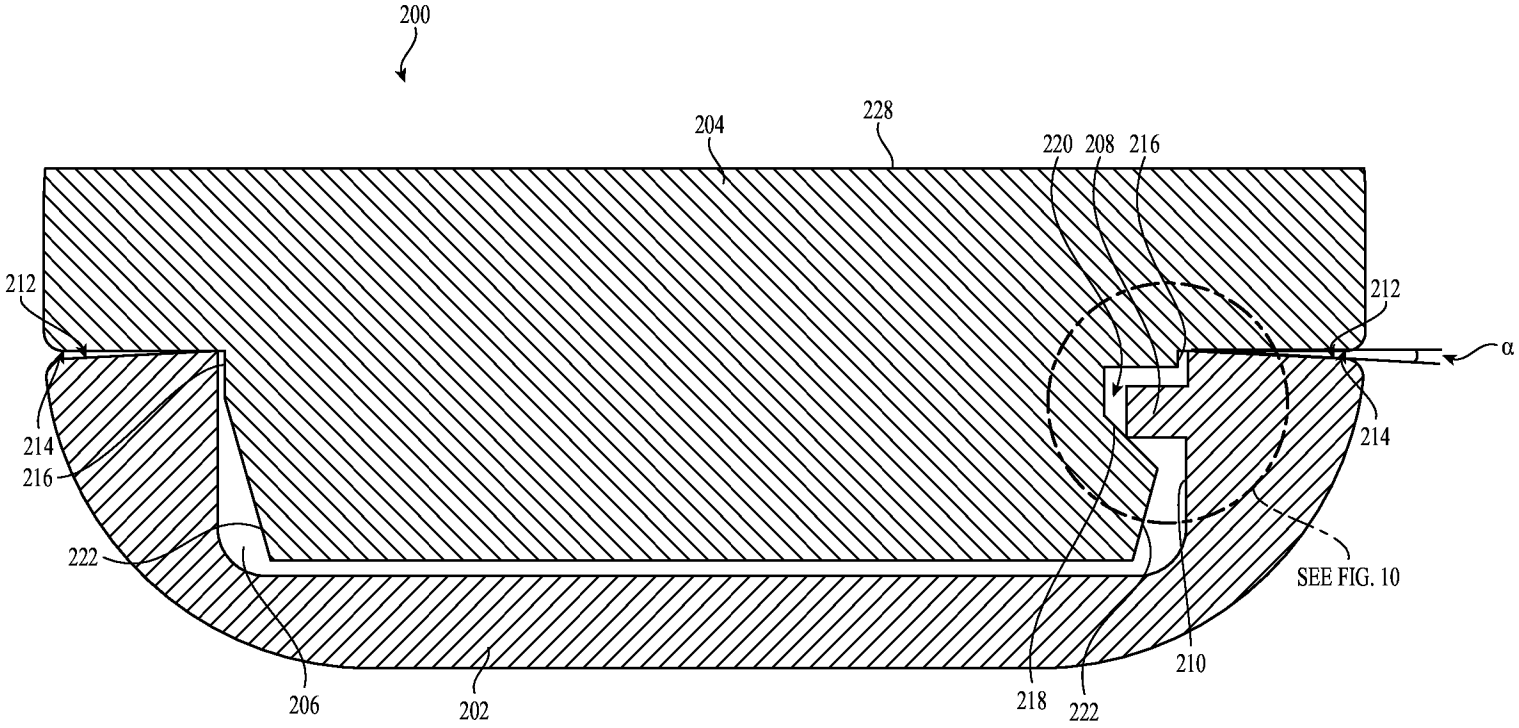
FIG. 7 shows a side cross-sectional view of a casing assembly, according to embodiments.
Figure 8:
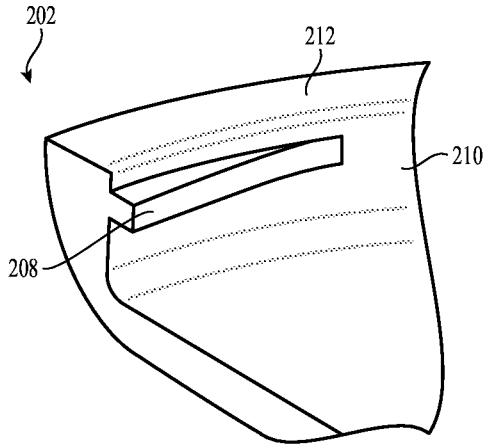
FIG. 8 shows a perspective view of a portion of a bottom case for a casing assembly, according to embodiments.

Turning to FIG. 7, a cross-sectional side view of a casing assembly 200 is shown, according to embodiments. As shown in FIG. 7, casing assembly 200 may include a bottom case 202 and top case 204 positioned above and coupled to bottom case 202. Bottom case 202 and top case 204 may include substantially matching circular geometries, and may be concentrically aligned when coupled. However, it is understood, bottom case 202 and top case 204 of casing assembly 200 may include any substantially matching polygonal shape, where top case 204 may be coupled to bottom case 202. As shown in FIG. 7, bottom case 202 may include a cavity 206 configured to substantially receive a portion of top case 204. Casing assembly 200 formed from bottom case 202 and top case 204 may be assembled to form any external enclosure or casing for an electronic device (see, FIG. 1; enclosure 12), as discussed herein.

Bottom case 202 may also include a hook 208 extending perpendicularly from a sidewall 210. In a non-limiting example shown in FIG. 7, a portion of sidewall 210 of bottom case 202 may include hook 208 extending toward a center of bottom case 202 and hook 208 may be received within a groove or cutaway formed along at least a portion of the sidewall of the top case 204, as discussed herein. Briefly turning to FIG. 8, hook 208 may also be substantially angular with respect to the circumference of sidewall 210 of bottom case 202. That is, the distance from which hook 208 extends perpendicularly from sidewall 210 may gradually increase over a predetermined length or portion of the circumference of sidewall 210 of bottom case 202. The predetermined length or portion of the circumference of sidewall 210 may be dependent upon a plurality of features of casing system 200 including, but not limited to, the size of bottom portion 202 and/or top portion 204, the weight of bottom portion 202 and/or top portion 204, the required retention force between bottom case 202 and top case 204.

Additionally, the size of hook 208 may be dependent, at least in part, on similar features of casing system 200. As discussed herein, hook 208 may be configured to substantially engage top case 204 and may align top case 204 with respect to bottom case 202. This alignment may facilitate creating or maintaining a uniform aperture (e.g., reveal) along the exterior edges of the top case 204 and bottom case 202. The hook and receiving groove may be tightly tolerance to set a uniform aperture height (or other dimension) between the top case 204 and bottom case 202.

Returning to FIG. 7, bottom case 202 may also include an angled reveal surface 212. Angled reveal surface 212 may partially engage or contact a substantially straight underside 214 of top case 204. Angled reveal surface 212 may be angled relative to underside 214 of tope case 204 a predetermined angle ($\alpha$). In the non-limiting example, as shown in FIG. 7, predetermined angle ($\alpha$) may be approximately 1 degree (1°) relative to the horizontal or straight underside 214 of top case 204, although this angle may vary between embodiments. As discussed herein, angled reveal surface 212 may allow bottom case 202 to rotate while being coupled to or decoupled from top case 204, and substantially maintain the cosmetic reveal between bottom case 202 and top case 204. In many embodiments, the gap between the top case and bottom case (as defined by the angle of the angled reveal surface) is sufficiently small enough to conceal the abutment between the top case 204 and bottom case 202, such that the naked eye cannot discern the abutment from the exterior of the housing.

Figure 9:
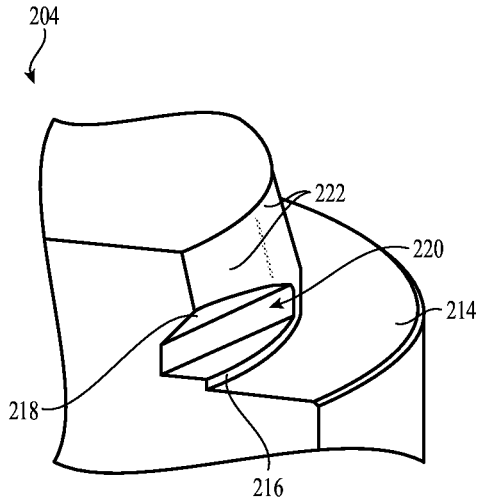
FIG. 9 shows a perspective view of a portion of a top case for a casing assembly, according to embodiments.
Figure 10:
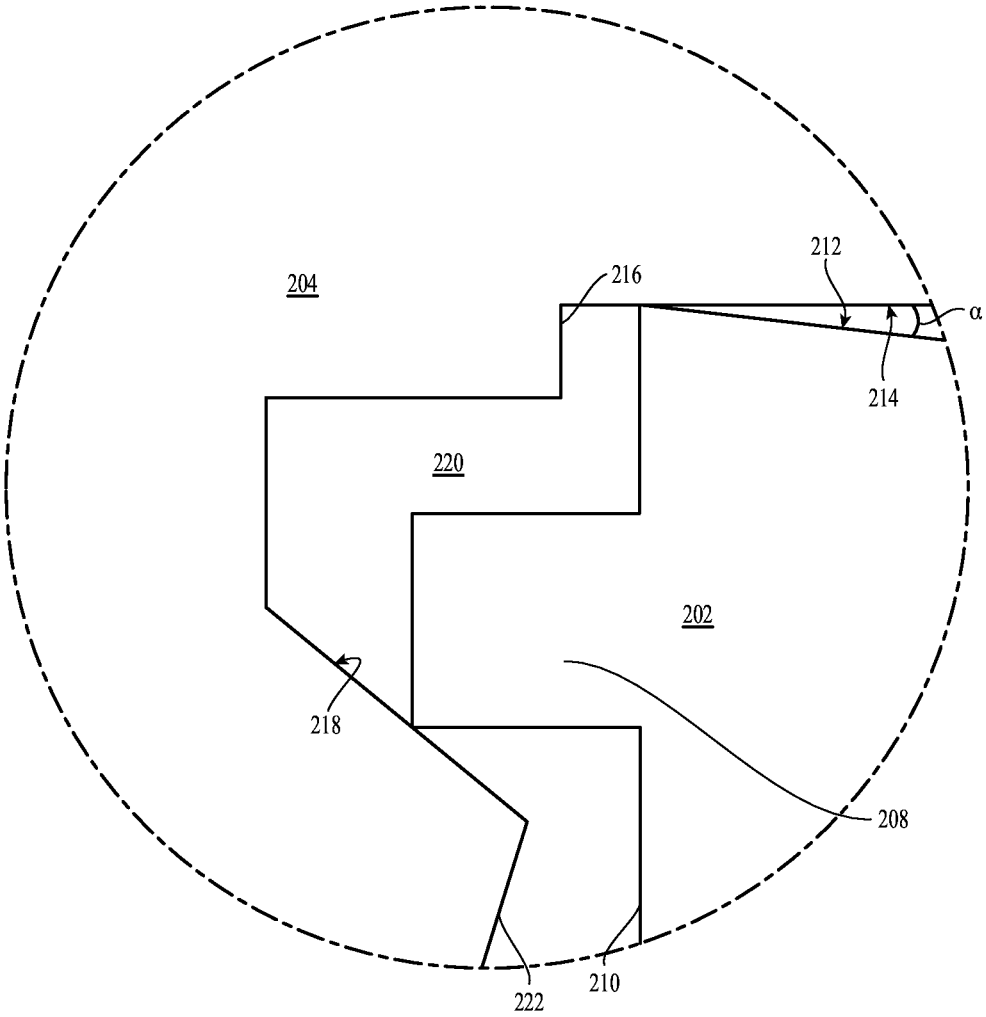
FIG. 10 shows an enlarged cross-sectional view of a portion of the casing assembly of FIG. 7, according to embodiments.

Top case 204 of case assembly 200 may include a plurality of features for maintaining the alignment and/or connection between top case 204 and bottom case 202. With reference to FIGS. 7, 9 and 10, top case 204 may include a stepped portion 216 positioned adjacent to, and extending perpendicularly relative to, underside 214. Stepped portion 216 of top case 204 may be positioned circumferentially around top case 204 and may extend toward and/or into cavity 206 of bottom case 202.

Additionally, as shown in FIGS. 7 and 10, stepped portion 216 may be positioned substantially adjacent to sidewalls 210 of bottom case 202. Stepped portion 216 of top case 204 may at least partially control a reveal offset between bottom case 202 and top case 204, and may also control the float or movement of bottom case 202 relative to top case 204. That is, stepped portion 216 may provide a contact point for sidewall 210 of bottom case 202 during the floating of bottom case 202, and may substantially limit bottom case's 202 ability to move relative to top case 204.

Top case 204 may also include angled contact surface 218 formed in cutout 220. As shown in FIGS. 7, 9 and 10, top case 204 may include cutout 220 positioned in circumferential alignment with hook 208 of bottom case 202, where angled contact surface 218 of cutout 220 may contact hook 208 for coupling top case 204 to bottom case 202. In a non-limiting example, angled contact surface 218 of top case 204 may contact hook 208, where hook 208 and angled contact surface 218 are aligned, and may hold bottom case 202 against top cover 204. As shown in FIG. 9, cutout 220 and angled contact surface 218 may be positioned along a portion of the circumference of top case 204 positioned within the bottom case cavity 206. In an alternative embodiment (not shown), cutout 220 and angled contact surface 218 may be positioned along the entire circumference of top case 204 positioned within cavity 206.

As shown in FIGS. 7, 9 and 10, top case 204 may also include a converging sidewall portion 222 positioned within cavity 206 of bottom case 202. Sidewall portion 222 of top case 204 may converge and/or be substantially angled down, and toward the center of top case 204. As discussed herein, sidewall portion 222 of top case 204 may aid in the ease of installation of top case 204 within bottom case 202 for forming casing system 200. Additionally, converging sidewall portion 222 may also provide clearance to rotate bottom case 202 away from top case 204 while uncoupling case assembly 200.

In many embodiments, one or more fasteners such as a screw, snap, adhesive or other mechanical or chemical fastener may join the top case 204 and bottom case 202, insofar as the hook alone may not resist decoupling of the two. The fastener(s) may be located at substantially any point along the exterior of the cases.

Figure 11:
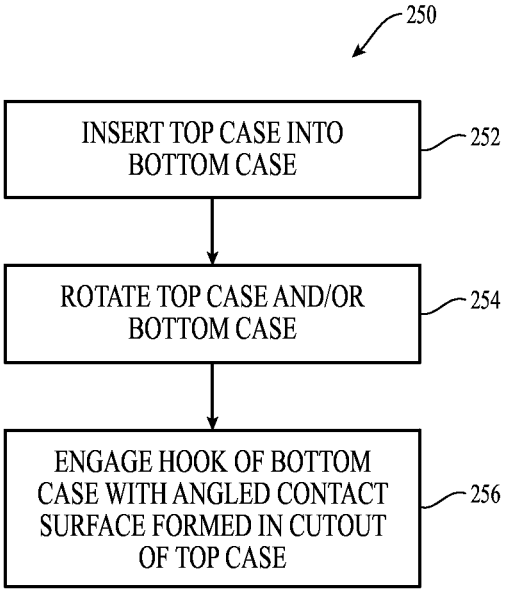
FIG. 11 is a flow chart illustrating a method for assembling a casing assembly. This method may be performed using the casing assembly as shown in FIGS. 7-10.

Turning to FIG. 11, a process of assembling a casing assembly may now be discussed. Specifically, FIG. 11 is a flowchart depicting one sample method 250 for assembling a casing assembly formed from a top case and a bottom case.

In operation 252, a top case may be inserted into a bottom case. In operation 254, at least one of the top case and/or the bottom case may be rotated. The top case and/or the bottom case may be rotated until a cutout of the top case is aligned with a hook of the bottom case. In operation 256, the hook of the bottom case may be engaged with an angled contact surface formed in the cutout of the top case.

Returning to FIG. 7, and with continued reference to FIG. 11, casing assembly 100 undergoing various operations of method 250 of FIG. 11 may be depicted. It is understood that similarly numbered components may function in a substantially similar fashion. Redundant explanation of these components has been omitted for clarity.

As discussed herein, a first operation of assembling casing assembly 200 may include inserting top case 204 into bottom case 202. As shown in FIG. 7, top case 204, including stepped portion 216, angled contact surface 218, cutout 220 and sidewall portion 222, may be inserted and positioned within cavity 206 of bottom case 202.

The converging angle of converging sidewall portion 222 of top case 204 may aid in inserting top case 204 into bottom case 202. D to the angled sidewall portions 222 of top case 204, top case 204 may be press-fitted onto or into bottom portion 202, and may not be substantially obstructed by hook 208 and/or sidewall 210 of bottom portion 202. In an additional embodiment, bottom case 202 may be pivotally coupled to top case 204. that is, hook 208 of bottom case 202 may be aligned and/or inserted into cutout 220 of top case 204, and subsequently, bottom case 202 may pivot about hook 208/cutout 220 and may be pushed against top case 204 until underside 214 of top case 204 contacts angled reveal surface 212 of bottom case 202.

Following the inserting of top case 204 into bottom case 202, a further operation includes rotating at least one of top case 204 and/or bottom case 202 to align cutout 220 of top case 204 with hook 208 of bottom case 202 may be performed. In a non-limiting example, top case 204 and/or bottom case 202 may be substantially rotated until hook 208 of bottom case 202 is positioned within the opening formed by cutout 220 of top case 204. Hook 208 of bottom case 202 and cutout 220 of top case 204 may be in substantial alignment when hook 208 is not contacting stepped portion 216 and/or sidewall portion 222 of top case 204, and underside 214 of top case 204 contacts angled reveal surface 212 of bottom case 202. Without physically seeing hook 208 in alignment or positioned within the opening formed by cutout 220, it may be understood that hook 208 of bottom case 202 is aligned in cutout 220 of top case 204 where underside 214 of top case 204 contacts angled reveal surface 212 of bottom case 202 and a top surface 228 of top case 204 is substantially even, horizontal, planar and/or level.

Finally, the method of assembling casing assembly 200 may include the operation of, engaging hook 208 with angled contact surface 218 of top case 204. More specifically, as shown in FIG. 7, after aligning cutout 220 of top case 204 and hook 208 of bottom case 202, hook 208 may engage angled contact surface 218 of top case 204 to hold bottom case 202 and top case 204 together.

Figure 12:
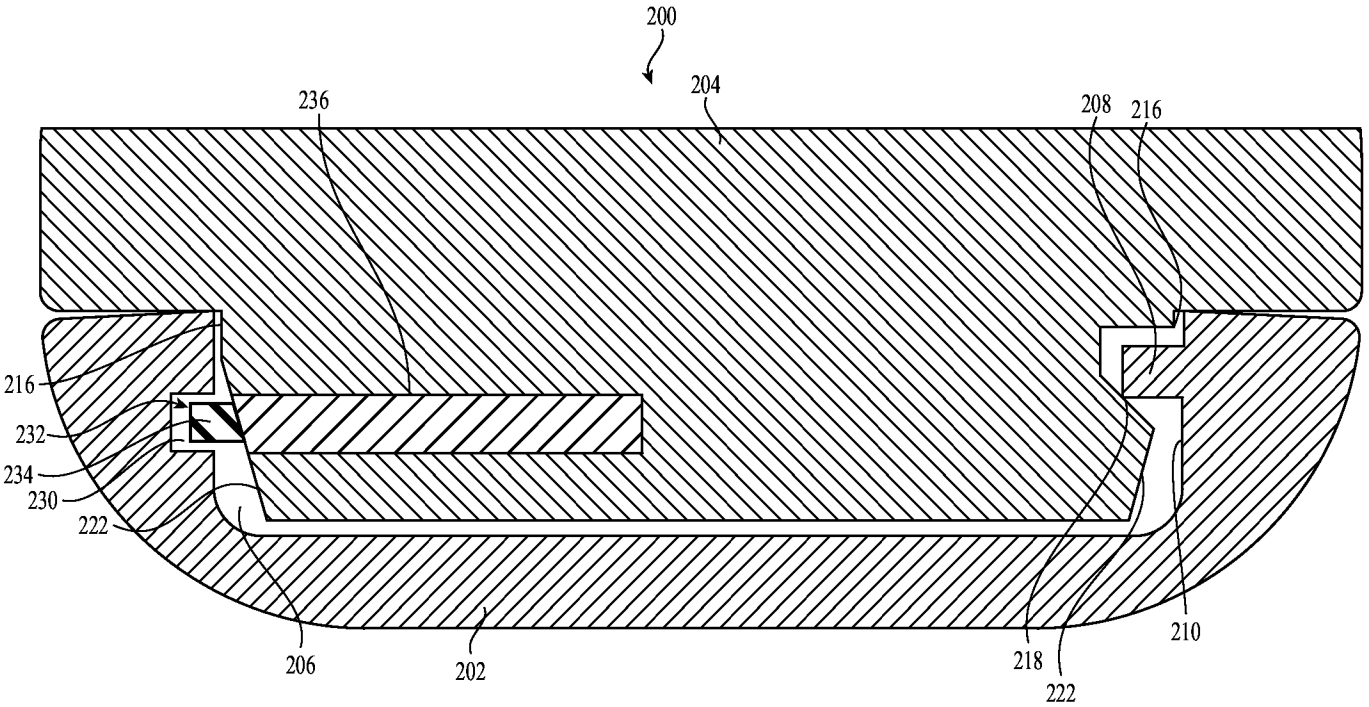
FIG. 12 shows a side cross-sectional view of a casing assembly, according to an additional embodiment.
Figure 13:
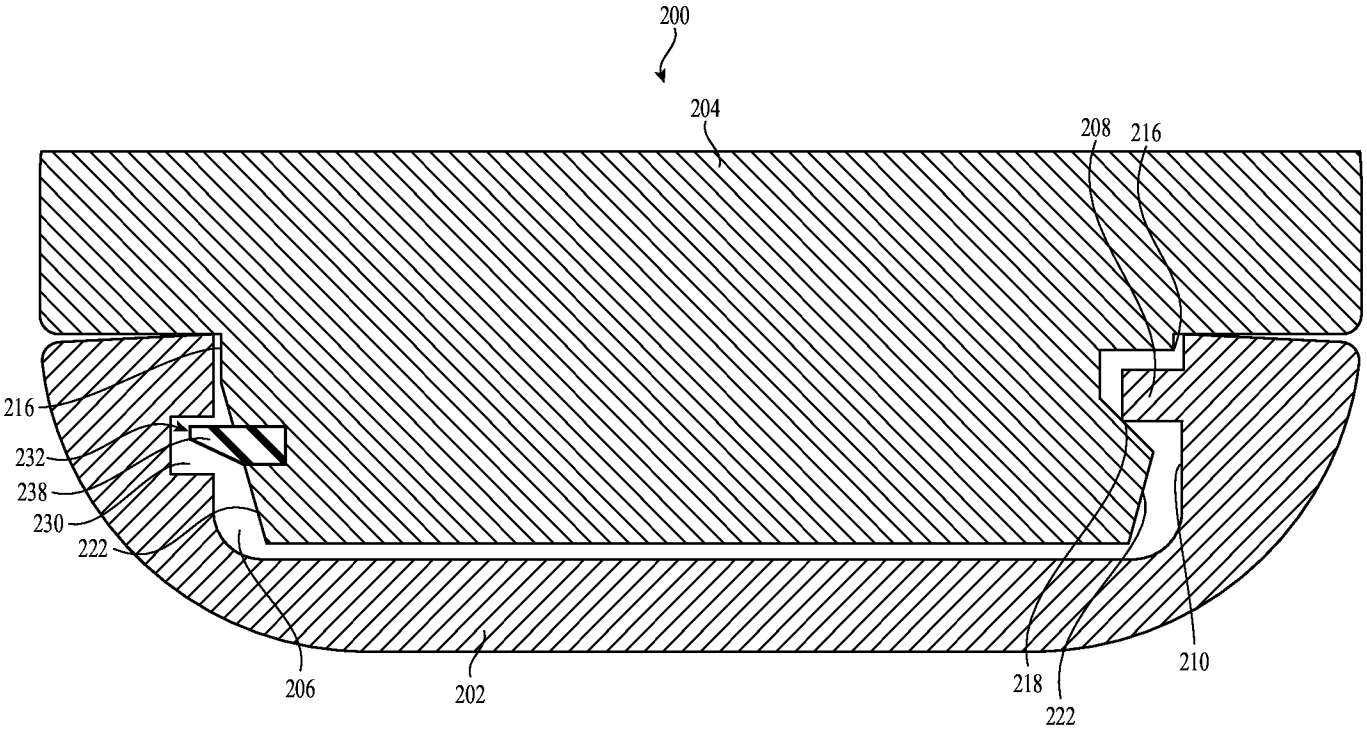
FIG. 13 shows a side cross-sectional view of a casing assembly, according to a further embodiment.

In some embodiments, and as shown in FIGS. 12 and 13, casing system 200 may include additional components for coupling top case 204 to bottom case 202. For example, as shown in FIGS. 12 and 13, bottom case 202 may include an aperture 230 extending partially through sidewall 210. Aperture 230 may be positioned substantially opposite hook 208 of bottom case 202, and may only be disposed over a portion of the circumference of the sidewall 210 of bottom case 202. Aperture 230 may be configured to receive a coupling mechanism 232 of top case 204 for providing additional support in coupling top case 204 to bottom case 202.

In a non-limiting example shown in FIG. 12, coupling mechanism 232 of top case 204 may include a spring clip 234 positioned within a groove 236 of top case 204. When inserting top case 204 into bottom case 202, spring clip 234 may be positioned within groove 236 and may be substantially flush with sidewall 222 of top case 204. Once spring clip 234 becomes aligned with aperture 230 of bottom case 202, a portion of spring clip 234 may extend into aperture 230 for retaining top case 204 within bottom case 202.

In as another non-limiting example shown in FIG. 13, coupling mechanism 232 for top case 204 may include a chamfered extrusion 238 extending from sidewall 222. Chamfered extrusion 238 may be press-fit into cavity 206 of bottom case 202. During the rotation of top case 204 and/or bottom case 202, chamfered extrusion 238 may become aligned and extend into aperture 230 for providing additional support in coupling top case 204 to bottom case 202.

In some embodiments, a snap may couple top case 204 to bottom case 202. Each of the top case 204 and bottom case 202 may have a portion of the snap formed thereon, such that the two cases are press-fitted together when properly aligned. The snap may be positioned where the interior wall of the bottom case is near or abuts the stepped portion 216, for example. Accordingly, the enclosure falls with its base impacting a surface, the force exerted on the snap by the impact is in shear and so the snap may resist decoupling of the top and bottom cases.

Figure 14:
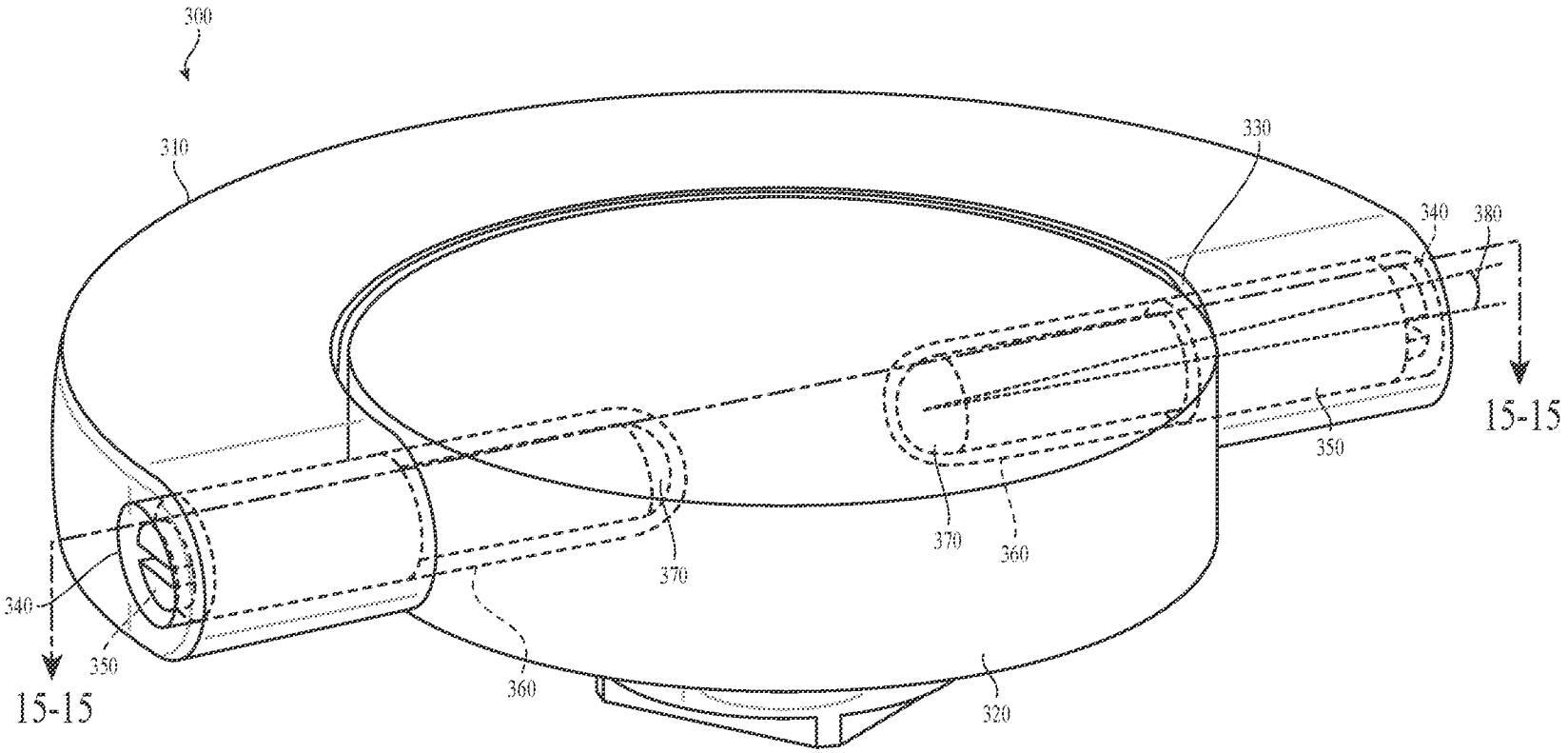
FIG. 14 illustrates a moveable handle for an electronic device according to one or more embodiments.

A bi-stable handle is now discussed. FIG. 14 illustrates a moveable handle 300 for an electronic device according to one or more embodiments of the present disclosure. In certain embodiments, the moveable handle 300 may be a handle for an electronic device, such as, for example, a camera, mobile phone, tablet computing device and the like. Additionally, moveable handle 300 may be coupled to a plug that may be inserted into an opening of an electronic device (see, FIG. 1; battery charging port 22; headphone port 24) to protect the opening from undesirable contaminants (for example, dust, water and so on).

The moveable handle 300 may have a variety of sizes and uses depending on various embodiments. For example, the handle may be large enough to be grasped by a hand of an individual that is carrying the electronic device. Alternatively, the movable handle 300 may be configured to be attached to a clasp or other such mechanism. Although a handle is specifically mentioned, it is contemplated that the embodiments described herein may be used for other purposes. For example, one or more embodiments provide that the components shown and described herein may be used for any component in which a first sub-component moves about an axis of a second sub-component, such as, for example, a covering for peripheral ports of an electronic device.

In one or more embodiments, the moveable handle 300 includes a handle portion 310 and a housing portion 320. In certain embodiments, a first portion of the handle portion 310 may be secured to the housing portion 320 while a second portion of the handle portion 310 rotates from a first position to a second position about an axis. For example, the handle portion 310 may move from a first position (or a "closed" position shown in FIG. 14) to a second position (or "open" position (not shown)). In certain embodiments, the housing portion 320 may be a cover or plug for the electronic device. In another embodiment, the housing portion 320 may be a button associated with the electronic device. In yet another embodiment, the housing portion 320 may be moveably coupled to a housing of the electronic device.

In embodiments, to facilitate the movement of the handle portion 310 about the housing portion 320, a small gap 330 is present between the handle portion 310 and the housing portion 320. In certain embodiments, the gap 330 between the handle portion 310 and the housing portion 320 remains constant around the entire circumference of the housing portion 320 due to the construction and configuration of the various components of the moveable handle 300 described herein.

As shown in FIG. 14, one or more embodiments provide that the moveable handle 300 is circular. Specifically, one or more embodiments provide that both the handle portion 310 and the housing portion 320 are circular. Although a circular design is specifically shown and described, it is contemplated that the handle portion 310 and the housing portion 320, as well as the overall shape of the moveable handle 300, may take any number of shapes (e.g., square, rectangular, oval, and so on).

With respect to the handle portion 310, one or more embodiments provide that the handle portion 310 includes a through hole 340 configured to receive a set screw 350. In embodiments, at least a portion of the through hole 340, and at least a portion of the set screw 350, is threaded (see, FIG. 15). In embodiments where at least a portion of the set screw 350 and at least a portion of the through hole 340 is threaded, the threaded portion of the set screw 350 is received into the threaded portion of the through hole 340. A locking mechanism may also be used to secure the set screw 350 within the through hole 340 to ensure that the set screw 350 does not become loose as the handle portion 310 moves from the first position to the second position and vice versa.

With respect to the housing portion 320, one or more embodiments provide that the housing portion 320 includes at least one blind hole 360. In certain embodiments, the blind hole 360 is configured to receive a distal end 370 of the set screw 350 so as to secure the handle portion 310 to the housing portion 320. In certain embodiments, the distal end 370 of set screw 350 is smooth and has a hemispheric tip.

Likewise, the blind hole 360 may have a smooth surface and have a hemispheric end. In such embodiments, when the distal end 37 of the set screw 350 is received into the blind hole 360, the distal end 370 of the set screw 350 is configured to rotate within the blind hole 360 as the handle portion 310 moves from the first position to the second position.

Although one portion of the set screw 350 rotates within the blind hole 360, a thread lock on the set screw 350 controls and maintains the torque and the friction of the handle portion 310. In embodiments, the thread lock may be caused by the threaded portion of the set screw 350 being received by the threaded portion of the through hole 340. Likewise, the torque caused by the thread lock helps maintain the concentricity and the gap 330 between the handle portion 310 and the housing portion 320.

In certain embodiments, the through hole 340 may be positioned with an angular offset 380 with respect to the blind hole 360. This off-axis design generates a bi-stable feel for the handle portion 310 as it moves from the first position to the second position. As a result, when the handle moves from the first position to the second position, the handle may "snap" or move automatically in place once the handle portion 310 moves past a certain point or angle threshold. For example, if the handle portion 310 is moving from the "closed" position shown in FIG. 14 to an "open" position, the handle portion 310 may "snap" or automatically move to the open position after reaching a predetermined angle threshold with respect to the housing portion 320 (e.g., a 40 degree angle). Likewise, when the handle portion 310 moves from an "open" position to a closed position, the handle portion 310 may "snap" or automatically move to the "closed" position, after the handle portion has reached a predetermined angle threshold with respect to the housing portion 320 (e.g., a 60 degree angle).

Figure 15:
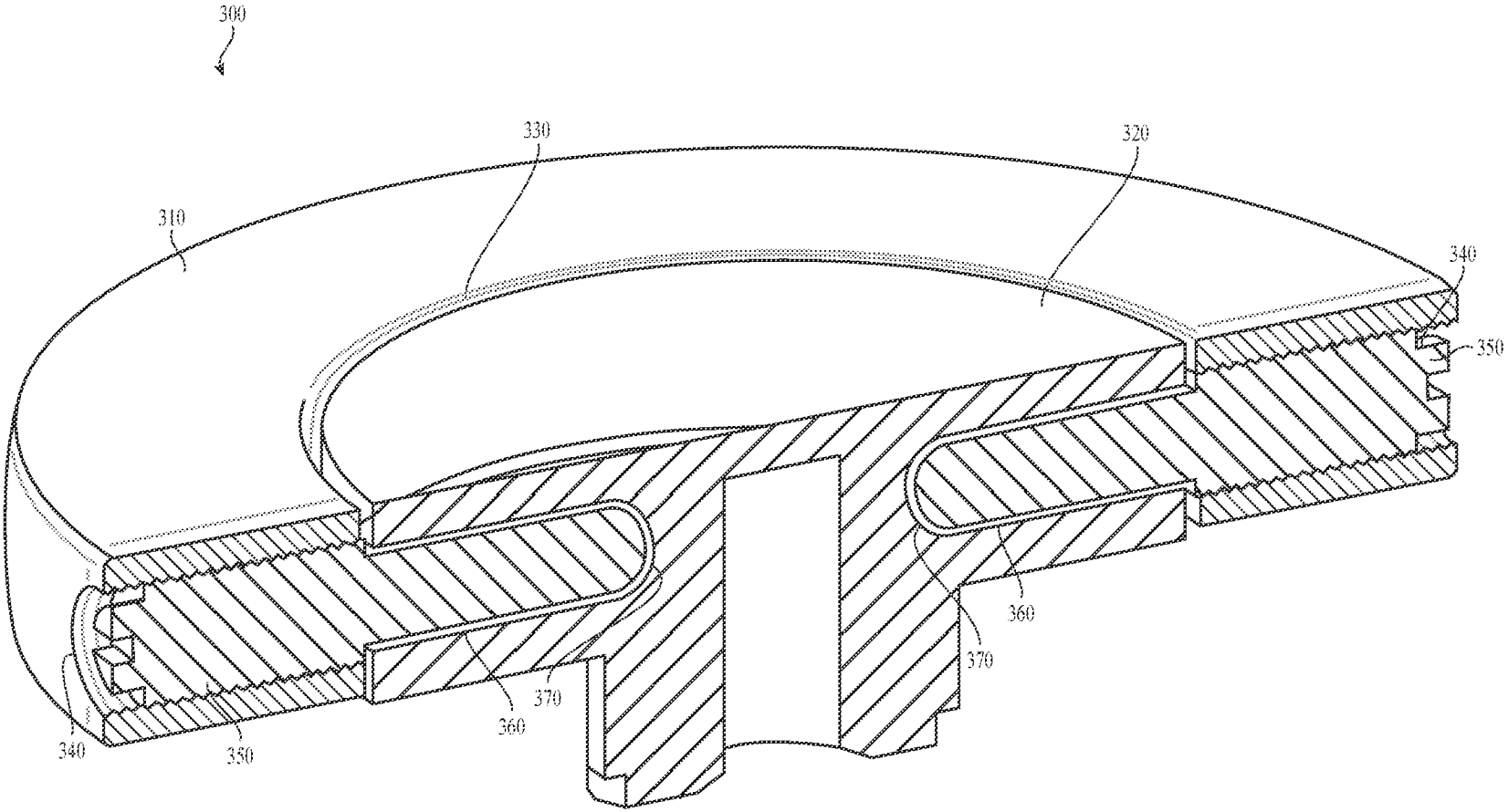
FIG. 15 illustrates a cross-section view of the moveable handle of FIG. 14, taken along line 15-15, according to one or more embodiments.

FIG. 15 illustrates a cross-sectional view of the moveable handle 300 according to one or more embodiments of the present disclosure. As discussed above, the moveable handle 300 includes a handle portion 310 and a housing portion 320. The handle portion 310 has one or more through holes 340 which enable a set screw 350 to secure the handle portion 310 to the housing portion 320. In a non-limiting example shown in FIG. 15, the through hole 340, and at least a portion of the set screw 350 are threaded to enable a user or individual to set the torque and/or friction of the moveable handle 300.

As also shown in FIG. 15, a distal end 370 of the set screw 350 may be received into a blind hole 360 of the housing portion 320. In embodiments, the set screw 350 has a hemispheric tip that mates with a hemispheric end of the blind hole 360. As also discussed above, one or more embodiments provide that the through hole 350 and the blind hole 360 are offset at a small angle in order to provide a bi-stable feel to the moveable handle 300.

Figure 16:
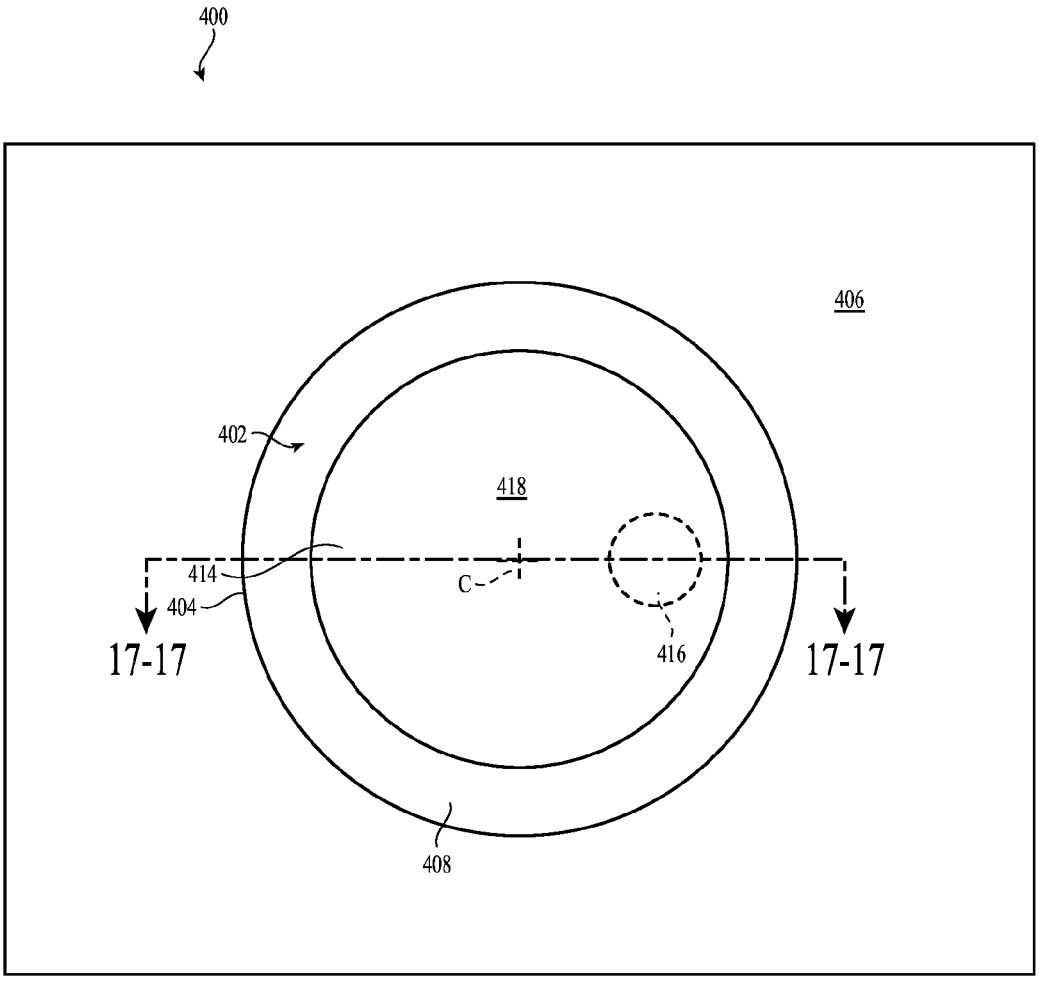
FIG. 16 shows a top perspective view of a portion of a housing and a gap control button assembly, according to embodiments.

FIG. 16 shows a top perspective view of a portion of a housing 400 and a gap control button assembly 402, according to embodiments of the invention. Housing 400, as shown in FIG. 16 may be any external structure or casing for any suitable electronic device (see, FIG. 1), including, but not limited to: a computer, a tablet, a cellular phone, a personal music device, a watch, and the like, as discussed herein. Housing 400 may include an opening 404 extending through at least a top surface 406 of housing 400 to an internal cavity 408 of housing 400. As discussed herein, opening 404 and/or cavity 408 may be configured to receive gap control button assembly 402 utilized by the electronic device (see, FIG. 1) including housing 400.

Figure 17:
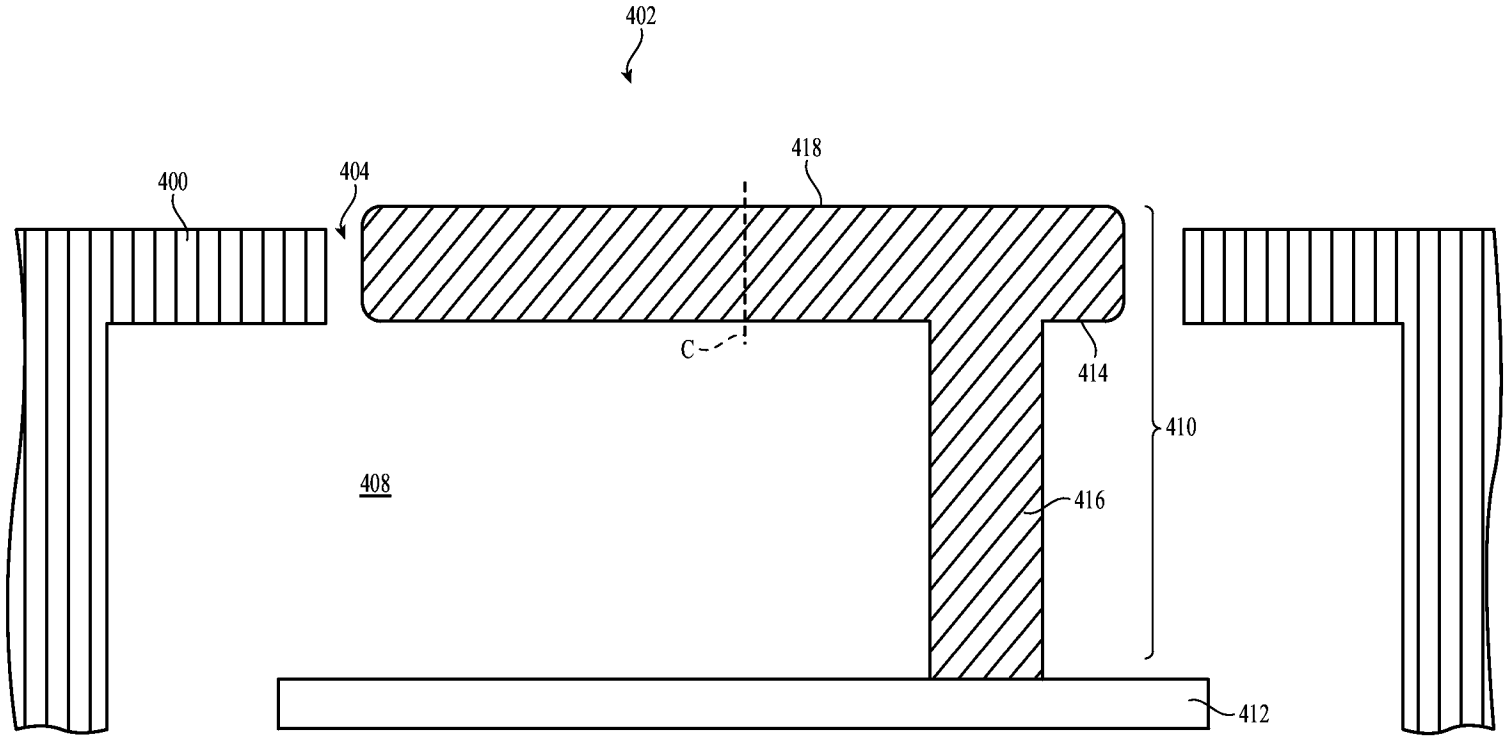
FIG. 17 shows side cross-section view of a portion of the housing and the gap control button assembly of FIG. 16, taken along line 17-17, according to embodiments.

Turning to FIGS. 16 and 17, gap control button assembly 402 may include a button 410 and an internal component 412 (FIG. 17) operatively connected to button 410. As shown in FIG. 17, button 410 of gap control button assembly 402 may include a body portion 414 positioned above internal component 412 and a pin portion 416 positioned between body portion 414 and internal component 412. Alternatively, pin portion 416 may be formed integral with body portion 414 to form button 410. As discussed herein, a top surface 418 of body portion 414 may be exposed when gap control button assembly 408 is positioned within housing 400. During the actuation of button 410, pin portion 416 may substantially contact internal component 412, to initiate a function of button assembly 408.

As shown in FIGS. 16 and 17, pin portion 416 of gap control button assembly 408 may be positioned substantially off-center (C) from body portion 414 and/or button 410. In non-limiting example, pin portion 416 may be coupled to body portion 414 of button 410 out of alignment with the center (C) of body portion 414. As shown in FIGS. 16 and 17 pin portion 416 may be positioned off-center, and to the right of the center (C) of body portion 414. However, it is understood that pin portion 416 may be positioned off-center, in any direction relative to the center (C) of body portion 414 of button 410. As discussed herein, by including off-center pin portion 416 in gap control button assembly 402, body portion 414 of button 410 may be configured to substantially rotate within opening 404 of housing 400.

Figure 18:
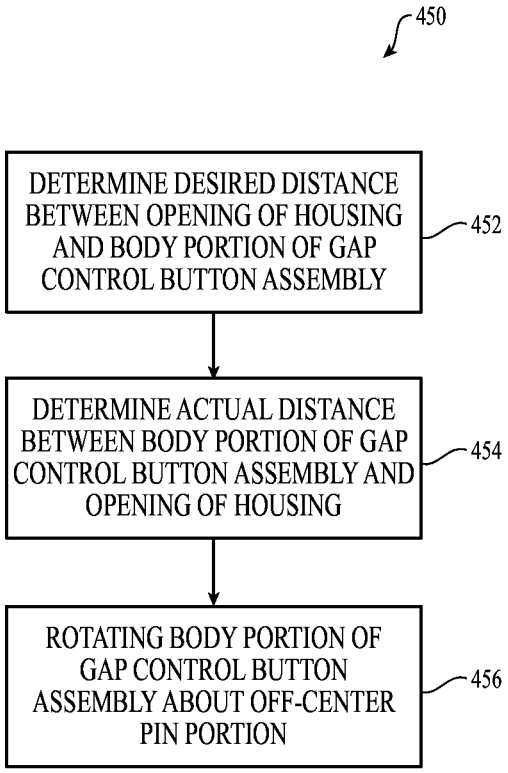
FIG. 18 is a flow chart illustrating a method for centering a gap control button assembly within an opening of a housing. This method may be performed using the gap control button assembly and housing as shown in FIGS. 16 and 17.

Turning to FIG. 18, a process of centering a gap control button assembly may now be discussed. Specifically, FIG. 18 is a flowchart depicting one sample method 450 for centering a gap control button assembly within an opening of a housing.

In operation 452, a desired distance between an opening of a housing and a body portion of a gap control button assembly may be determined. In operation 454, an actual distance between a body portion of the gap control button assembly and the opening of the housing may be determined. In operation 456, the body portion of the gap control button assembly may be rotated about an off-centered pin portion of the gap control button assembly. The rotating of the body portion may position the body portion of the gap control button assembly within the opening of the housing at a desired distance.

Figure 19A:
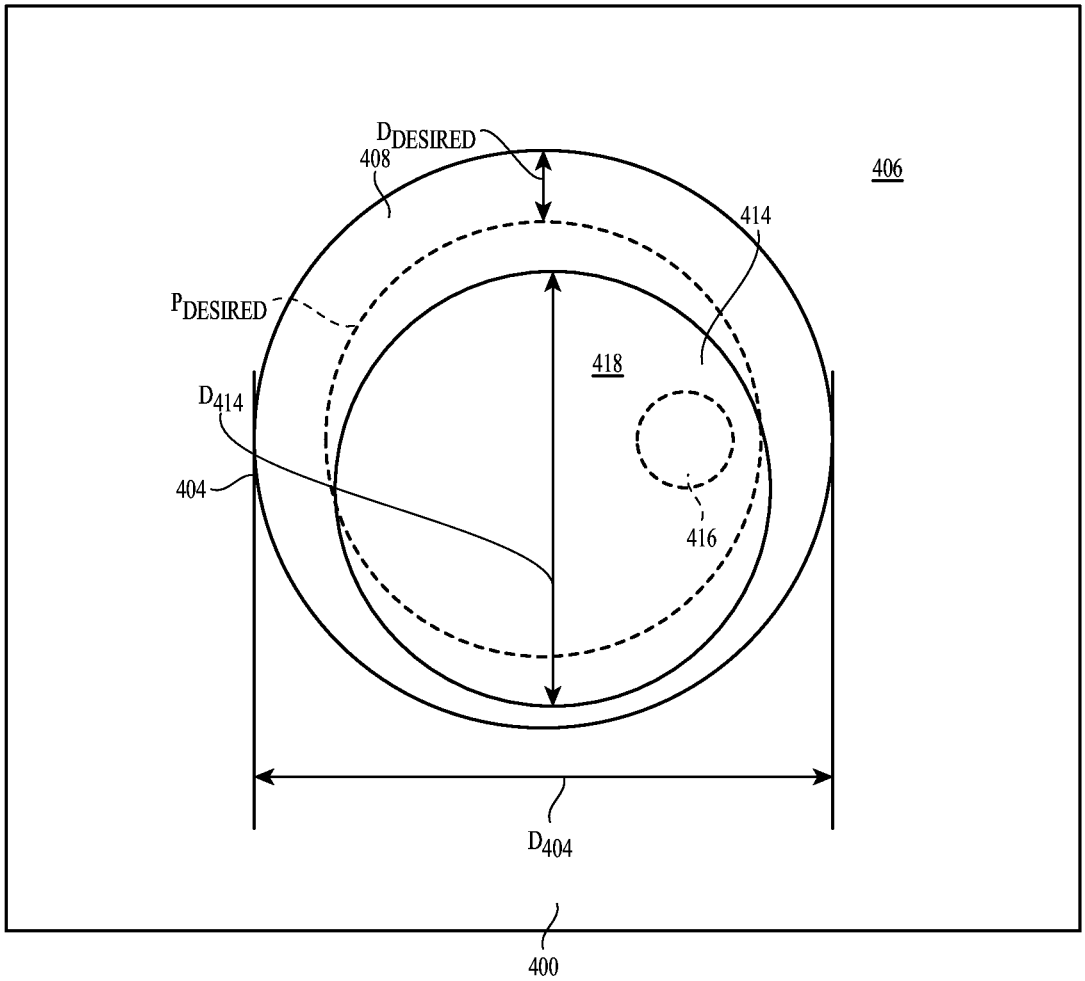
FIGS. 19A-19C show illustrative top views of a gap control button assembly and a housing undergoing processes of installation as depicted in FIG. 18, according to embodiments.
Figure 19B:
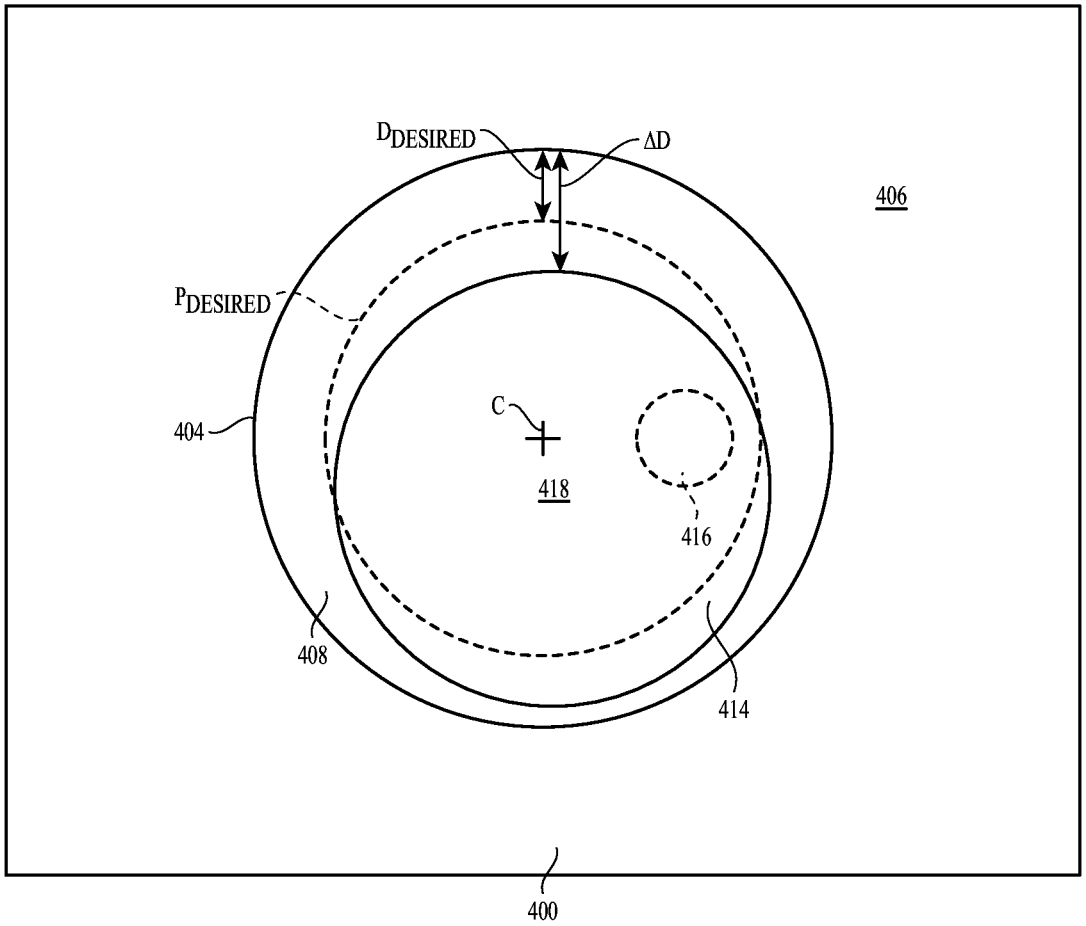
Figure 19C:
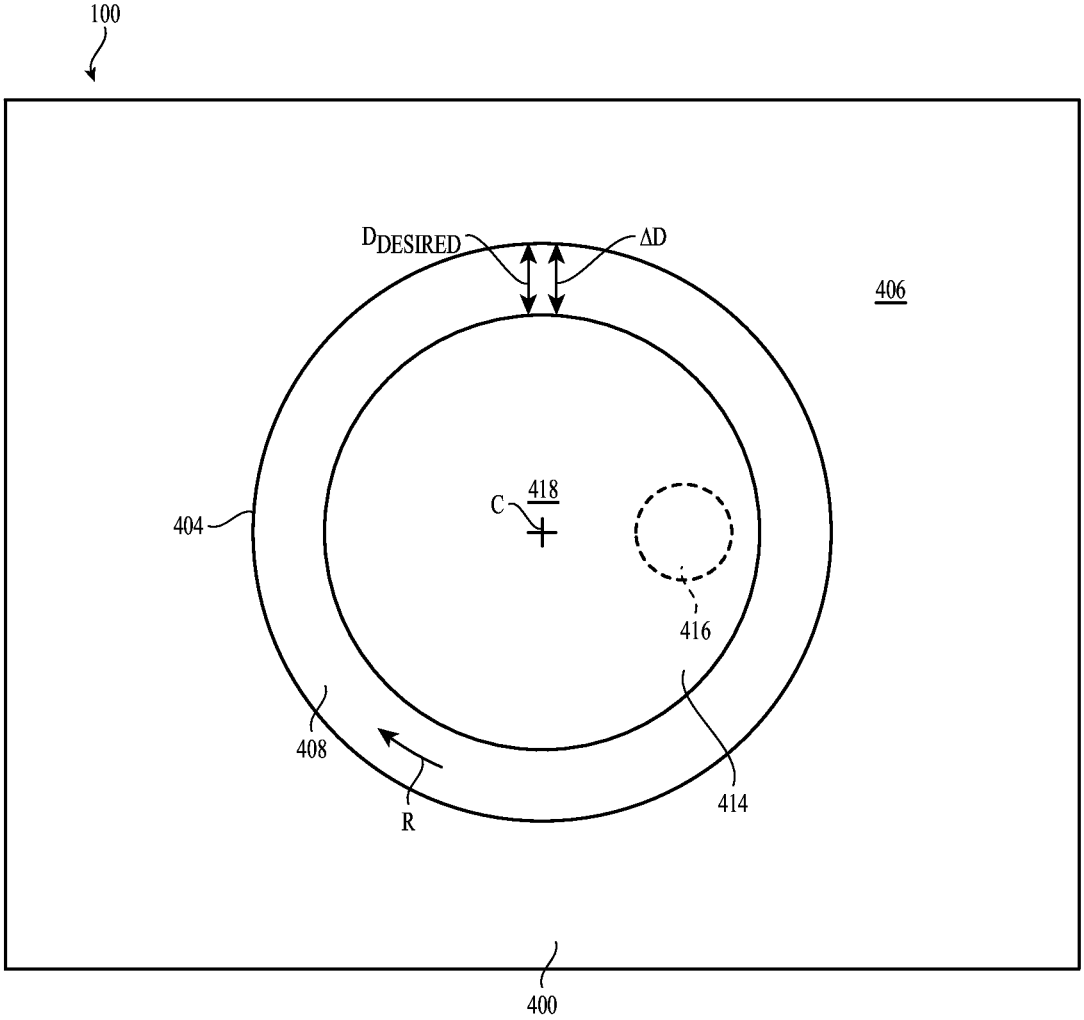

Turning to FIGS. 19A-19C, gap control button assembly 402 and housing 400 undergoing various operations of method 450 of FIG. 18 may be depicted. It is understood that similarly numbered components may function in a substantially similar fashion. Redundant explanation of these components has been omitted for clarity.

As shown in FIG. 19A, a first operation of centering gap control button assembly 402 includes determining a desired distance ($D_{Desired}$) between opening 404 of housing 400 and body portion 414 of gap control button assembly 402. Determining the desired distance ($D_{Desired}$) between opening 404 and button 410 may include comparing a first diameter ($D_{404}$) of opening 404 of housing 400 with a second diameter ($D_{414}$) of button 410 of gap control button assembly 402. The determining of the desired distance ($D_{Desired}$) between opening 404 of housing 400 and body portion 414 of gap control button assembly 402, shown in FIG. 19A, may correspond to operation 452.

By comparing the first diameter ($D_{404}$) of opening 404 of housing 400 with a second diameter ($D_{414}$) of button 410 of gap control button assembly 402, the desired distance ($D_{Desired}$) between opening 404 and button 410 may be determined. This determined desired distance ($D_{Desired}$) may be the uniform or equal distance between body portion 414 and opening 404 to position body portion 414 in the center or substantially align body portion 414 with the center of opening 404. As discussed herein, where body portion 414 is substantially aligned within the center of opening 404, the gap spacing of opening 404 surrounding body portion 414 may be uniform.

As shown in FIG. 19A, the center alignment may be shown as a desired position ($P_{Desired}$, shown in phantom) for body portion 414. First diameter ($D_{404}$) and second diameter ($D_{414}$) may be predetermined during the manufacturing of housing 400 and gap control button assembly 402, respectively. Alternatively, first diameter ($D_{404}$) and second diameter ($D_{414}$) may be determined after manufactured, and just prior to gap control button assembly 402 being installed within housing 400. First diameter ($D_1$) and second diameter ($D_{414}$) may be determined using various techniques and/or measuring tools including, but not limited to: optical scans, micrometers, pressure sensitive impressions, and the like.

FIG. 19B shows an additional operation of centering gap control button assembly 402 including, determining the actual distance (ΔD) between body portion 414 of gap control button assembly 402 and opening 404 of housing 400. The actual distance (ΔD) between a body portion 414 and opening 404 may be determined and compared to the determined, desired distance ($D_{Desired}$) between opening 404 and body portion 414. Where the actual distance (ΔD) differs from the desired distance ($D_{Desired}$), body portion 414 may not be in alignment with the center of opening 404, and the gaps between body portion 414 and opening 404 may not be uniform. In the non-limiting example, as shown in FIG. 19B, the actual distance (ΔD) between body portion 414 and opening 404 may be greater than the desired distance ($D_{Desired}$). As such, body portion 414 may not be in alignment with the center (C) of opening 404, and may not include a uniform gap between body portion 414, and opening 404. This may be further clarified in comparing the actual position of body portion 414 with the desired position ($P_{Desired}$) (shown in phantom) for body portion 414, as shown in FIG. 19B. The determining of the actual distance (ΔD) between body portion 414 of gap control button assembly 402 and opening 404 of housing 400, shown in FIG. 19B, may correspond to operation 454.

Turning to FIG. 19C, a subsequent operation of centering gap control button assembly 402 is shown according to embodiments of the invention. The step, as shown in FIG. 19C, includes rotating body portion 414 of button 410 about off-centered pin portion 416, in response to determining the actual distance (ΔD) between a body portion 414 and opening 404 differs from the desired distance ($D_{Desired}$). The rotating of body portion 414 of button 410 about off-centered pin portion 416, shown in FIG. 19C, may correspond to operation 456.

In the non-limiting example, body portion 414 may be rotated about pin portion 416 (shown in phantom) of button 410 in a direction dependent upon whether the actual distance (ΔD) is greater than or less than the desired distance ($D_{Desired}$). Where the actual distance (ΔD) is greater than the desired distance ($D_{Desired}$), body portion 414 may be rotated toward the measuring reference points for determining the distances (e.g., ΔD, $D_{Desired}$). Conversely, where the actual distance (ΔD) is less than the desired distance ($D_{Desired}$), body portion 414 may be rotated away from the measuring reference points for determining the distances.

Continuing the example above, where the actual distance (ΔD) of body portion 414 was greater than the desired distance ($D_{Desired}$), as shown in FIG. 19B, body portion may be rotated in a direction (R) as shown in FIG. 19C, to align body portion 414 with the center (C) of opening 404. In the non-limiting example shown in FIG. 19C, by rotating body portion 414 about off-centered pin 416 in the direction (R), the actual position of body portion 414 may now be in alignment with the desired position ($P_{Desired}$)(FIG. 19B) for body portion 414. Additionally, as a result of rotating body portion 414 in the direction (R), the actual distance (ΔD) may now be equal to the desired distance ($D_{Desired}$). As such, button 410 may include a uniform gap between body portion 414 and opening 404, and gap control button assembly 402 may be substantially centered within opening 404.

By including off-center pin portion 416 of button 410, and allowing body portion 414 to rotate within opening 404 of housing 400, the suitable coupling of internal component 412 within housing 400 may not require precise placement. That is, internal component 412 may be coupled within cavity 408 of housing 400, but may not require center alignment of body portion 414 with opening 404, as is conventionally known. Rather, by utilizing pin portion 416 and the ability to rotate body portion 414, body portion 414 of button 410 may be substantially centered or concentrically aligned within opening 404 of housing 400 after gap control button assembly 402 is installed within housing 400.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A button assembly comprising:

a body portion;

a contact portion coupled to the body portion;

a sacrificial material coupled to and surrounding at least a portion of the body portion, the sacrificial material contacting and coupling the body portion to an aperture formed through a housing of an electronic device; and an internal component coupled to the contact portion, opposite the body portion, the internal component coupled to the housing of the electronic device subsequent to the coupling of the body portion to the aperture via the sacrificial material.

2. The button assembly of claim 1, wherein the body portion is positioned within the aperture of the electronic device.

3. The button assembly of claim 1, wherein the sacrificial material comprises an outer diameter substantially equal to an inner diameter of the aperture of the electronic device.

4. The button assembly of claim 1, wherein the internal component is coupled to a portion of the housing of the electronic device opposite the aperture.

5. A method of installing a button assembly within a housing of an electronic device, the method comprising:

determining an inner diameter of an aperture formed in the housing of the electronic device;

removing at least a portion of a sacrificial material coupled to and surrounding at least a portion of a body portion of the button assembly;

positioning the body portion of the button assembly within the aperture of the housing; and affixing the button assembly to the housing of the electronic device.

6. The method of claim 5, wherein the affixing the button assembly to the housing further comprises:

subsequent to the positioning of the body portion of the button assembly within the aperture, coupling an internal component of the button assembly to the housing of the electronic device, the internal component coupled to the body portion via a contact portion.

7. The method of claim 5, wherein the removing of at least the portion of the sacrificial material further comprises:

resizing an outer diameter of the sacrificial material to be substantially equal to an inner diameter of the aperture formed through the housing.

8. The method of claim 5, wherein the positioning of the body portion of the button assembly within the aperture of the housing further comprises:

coupling the sacrificial material to the aperture formed through the housing.

9. A casing assembly comprising:

a bottom case comprising:

a cavity;

a hook extending into the cavity; and a chamfered reveal surface surrounding the cavity; and a top case having a cutout for receiving the hook to couple the top case to the bottom case;

wherein the chamfered reveal surface defines an opening along an exterior surface of the casing assembly.

10. The casing assembly of claim 9, wherein the top case further comprises converging sidewall portions positioned within the bottom case.

11. The casing assembly of claim 9, wherein the chamfered reveal surface of the bottom case is angled 1 degree relative to a straight underside of the top case.

12. The casing assembly of claim 9, wherein the bottom case further comprises an aperture formed in a sidewall opposite the hook.

13. The casing assembly of claim 12, wherein the top case further comprises a spring clip positioned opposite the cutout, the spring clip positioned within the aperture of the bottom case for coupling the top case to the bottom case.

14. The casing assembly of claim 12, wherein the top case further comprises a chamfered extrusion positioned opposite the cutout, the chamfered extrusion positioned within the aperture of the bottom case for coupling the top case to the bottom case.

15. A method of assembling a casing assembly for an electronic device, the method comprising:

inserting a top case into a bottom case;

abutting at least a portion of the top case with a chamfered reveal surface of the bottom case, wherein the chamfered reveal surface defines an opening along an exterior surface of the casing assembly;

rotating at least one of the top case and the bottom case; and engaging a hook of the bottom case with an angled contact surface of a cutout formed in the top case while maintaining the abutment of the portion of the top case with the chamfered reveal surface.

16. The method of claim 15, wherein the rotating of at least one of the top case and the bottom case further comprises aligning the hook of the bottom case with the cutout formed in the top case.

17. The method of claim 15 further comprising aligning a coupling mechanism of the top case with an aperture of the bottom case formed in a sidewall opposite the hook.

18. The method of claim 17, wherein the coupling mechanism comprises one of:

a spring clip, or a chamfered extrusion.

19. A gap control button assembly within a housing, comprising:

a body portion positioned within an opening of the housing;

a pin portion affixed to the body portion; and an internal component wherein:

the pin portion is rotatably coupled to the internal component within the housing along a rotation axis;

the rotation axis is parallel to and offset with respect to a center axis of the body portion; and the rotation axis is located within the opening defined by the housing.

20. The gap control button assembly of claim 19, wherein the body portion is positioned within the center of the opening of the housing.

21. The gap control button assembly of claim 19, wherein the pin portion is coupled to the body portion between the center of the body portion and a perimeter of the body portion.

22. A method of centering a gap control button assembly within an opening of a housing, the method comprising:

determining a desired distance between the opening of the housing and a body portion of the gap control button assembly;

determining an actual distance between the body portion of the gap control button assembly and the opening of the housing; and rotating the body portion about an axis extending through the opening and an off-center pin portion of the gap control button assembly, the pin portion affixed to the body portion.

23. The method of claim 22, wherein the rotating of the body portion further comprises positioning the body portion of the gap control button assembly within the opening of the housing at the determined desired distance.

24. The method of claim 22, wherein the determining of the desired distance between the opening of the housing and the body portion of the gap control button assembly further comprises:

measuring an outer diameter of the body portion of the gap control button assembly;

measuring an inner diameter of the opening of the housing;

comparing the outer diameter of the body portion to the inner diameter of the opening; and determining a desired, uniform gap spacing between the body portion of the gap control button assembly and the opening of the housing.

25. The method of claim 22 further comprising:

comparing the desired distance with the actual distance; and determining that the actual distance is one of greater than, or less than, the desired distance.

26. The method of claim 25, wherein in response to determining that the actual distance is greater than the desired distance, rotating the body portion of the gap control button assembly in a first direction; and wherein in response to determining that the actual distance is less than the desired distance, rotating the body portion of the gap control button assembly in a second direction, distinct from the first direction.

27. A handle assembly comprising:

a housing portion comprising a blind hole;

a handle portion coupled to the housing portion, the handle portion comprising a through hole with an angular offset from the blind hole of the housing portion; and a coupling mechanism positioned within both the blind hole of the housing portion and the through hole of the handle portion for coupling the handle portion to the housing portion;

wherein the handle portion is biased toward a first position from a second position relative to the housing portion.

28. The handle assembly of claim 27, wherein the handle portion is rotatably coupled to the housing portion and is configured to rotate from at least one of the first position to the second position about the housing portion.

29. The handle assembly of claim 27, wherein the coupling mechanism comprises a set screw comprising:

a distal end; and a threaded portion positioned adjacent the distal end.

30. The handle assembly of claim 29, wherein the through hole of the handle portion comprises threads for engaging the threaded portion of the set screw.

31. The handle assembly of claim 29, wherein the distal end of the set screw is positioned within the blind hole of the housing portion.

* * * * *